US009427127B2

(12) United States Patent
Dooley et al.

(10) Patent No.: US 9,427,127 B2
(45) Date of Patent: Aug. 30, 2016

(54) AUTONOMOUS SURFACE CLEANING ROBOT

(71) Applicant: iRobot Corporation, Bedford, MA (US)

(72) Inventors: Michael Dooley, Pasadena, CA (US); Nikolai Romanov, Oak Park, CA (US); James Phillip Case, Los Angeles, CA (US)

(73) Assignee: iRobot Corporation, Bedford, MA (US)

( * ) Notice: Subject to any disclaimer, the term of this patent is extended or adjusted under 35 U.S.C. 154(b) by 364 days.

(21) Appl. No.: 14/077,296

(22) Filed: Nov. 12, 2013

(65) Prior Publication Data

US 2015/0128996 A1 May 14, 2015

(51) Int. Cl.

| | |
|---|---|
| ***A47L 11/00*** | (2006.01) |
| ***A47L 11/40*** | (2006.01) |
| ***A47L 11/12*** | (2006.01) |

(52) U.S. Cl.

CPC ..... *A47L 11/4066* (2013.01); *A47L 11/125* (2013.01); *A47L 11/408* (2013.01); *A47L 11/4011* (2013.01); *A47L 11/4036* (2013.01)

(58) Field of Classification Search

CPC ..... A47L 11/125; A47L 11/4066; A47L 11/4061; A47L 11/4069; A47L 11/4072; A47L 11/4011; A47L 11/408

USPC ..... 15/319, 320

See application file for complete search history.

(56) References Cited

U.S. PATENT DOCUMENTS

| | | | |
|---|---|---|---|
| 3,729,041 | A | 4/1973 | Kubota |
| 4,319,379 | A | 3/1982 | Carrigan et al. |
| 4,967,862 | A | 11/1990 | Pong et al. |
| 5,440,216 | A | 8/1995 | Kim |
| 5,720,077 | A | 2/1998 | Nakamura et al. |
| 5,787,545 | A | 8/1998 | Colens |
| 5,815,880 | A | 10/1998 | Nakanishi |

(Continued)

FOREIGN PATENT DOCUMENTS

| | | | |
|---|---|---|---|
| EP | 1625949 | | 2/2006 |
| KR | 10-2012-0042391 | * | 3/2012 |

(Continued)

OTHER PUBLICATIONS

Anderson, "IMU Odometry", Jul. 27, 2006, SeattleRobotics.org.

(Continued)

*Primary Examiner* — Saeed T Chaudhry

(74) *Attorney, Agent, or Firm* — Honigman Miller Schwartz and Cohn LLP

(57) ABSTRACT

A mobile floor cleaning robot includes a body defining a forward drive direction, a drive system, a cleaning system, and a controller. The cleaning system includes a pad holder, a reservoir, a sprayer, and a cleaning system. The pad holder has a bottom surface for receiving a cleaning pad. The reservoir holds a volume of fluid, and the sprayer sprays the fluid forward the pad holder. The controller is in communication with the drive and cleaning systems. The controller executes a cleaning routine that includes driving in the forward direction a first distance to a first location, then driving in a reverse drive direction a second distance to a second location. From the second location, the robot sprays fluid in the forward drive direction but rearward the first location. The robot then drives in alternating forward and reverse drive directions while smearing the cleaning pad along the floor surface.

10 Claims, 21 Drawing Sheets

(56) References Cited

U.S. PATENT DOCUMENTS

| | | | |
|---|---|---|---|
| 5,841,259 | A | 11/1998 | Kim et al. |
| 5,894,621 | A | 4/1999 | Kubo |
| 5,940,927 | A | 8/1999 | Haegermarck et al. |
| 5,959,423 | A | 9/1999 | Nakanishi et al. |
| 5,991,951 | A | 11/1999 | Kubo et al. |
| 5,998,953 | A | 12/1999 | Nakamura et al. |
| 6,012,618 | A | 1/2000 | Matsuo |
| 6,076,025 | A | 6/2000 | Ueno et al. |
| 6,119,057 | A | 9/2000 | Kawagoe |
| 6,142,252 | A | 11/2000 | Kinto et al. |
| 6,327,741 | B1 | 12/2001 | Reed |
| 6,338,013 | B1 | 1/2002 | Ruffner |
| 6,389,329 | B1 | 5/2002 | Colens |
| 6,459,955 | B1 | 10/2002 | Bartsch et al. |
| 6,481,515 | B1 | 11/2002 | Kirkpatrick et al. |
| 6,532,404 | B2 | 3/2003 | Colens |
| 6,580,246 | B2 | 6/2003 | Jacobs |
| 6,594,844 | B2 | 7/2003 | Jones |
| 6,600,981 | B2 | 7/2003 | Ruffner |
| 6,690,134 | B1 | 2/2004 | Jones et al. |
| 6,741,054 | B2 | 5/2004 | Koselka et al. |
| 6,771,217 | B1 | 8/2004 | Liu et al. |
| 6,779,217 | B2 | 8/2004 | Fisher |
| 6,781,338 | B2 | 8/2004 | Jones et al. |
| 6,809,490 | B2 | 10/2004 | Jones et al. |
| 6,868,307 | B2 | 3/2005 | Song et al. |
| 6,883,201 | B2 | 4/2005 | Jones et al. |
| 6,901,624 | B2 | 6/2005 | Mori et al. |
| 6,938,298 | B2 | 9/2005 | Aasen |
| 6,965,209 | B2 | 11/2005 | Jones et al. |
| 7,013,527 | B2 | 3/2006 | Thomas et al. |
| 7,013,528 | B2 | 3/2006 | Parker et al. |
| 7,015,831 | B2 | 3/2006 | Karlsson et al. |
| 7,113,847 | B2 | 9/2006 | Chmura et al. |
| 7,135,992 | B2 | 11/2006 | Karlsson et al. |
| 7,145,478 | B2 | 12/2006 | Goncalves et al. |
| 7,155,308 | B2 | 12/2006 | Jones |
| 7,162,338 | B2 | 1/2007 | Goncalves et al. |
| 7,173,391 | B2 | 2/2007 | Jones et al. |
| 7,177,737 | B2 | 2/2007 | Karlsson et al. |
| 7,196,487 | B2 | 3/2007 | Jones et al. |
| 7,248,951 | B2 | 7/2007 | Hulden |
| 7,272,467 | B2 | 9/2007 | Goncalves et al. |
| 7,320,149 | B1 | 1/2008 | Huffman et al. |
| 7,346,428 | B1 | 3/2008 | Huffman et al. |
| 7,388,343 | B2 | 6/2008 | Jones et al. |
| 7,389,156 | B2 | 6/2008 | Ziegler et al. |
| 7,448,113 | B2 | 11/2008 | Jones et al. |
| 7,480,958 | B2 | 1/2009 | Song et al. |
| 7,539,557 | B2 | 5/2009 | Yamauchi |
| 7,571,511 | B2 | 8/2009 | Jones et al. |
| 7,620,476 | B2 | 11/2009 | Morse et al. |
| 7,636,982 | B2 | 12/2009 | Jones et al. |
| 7,761,954 | B2 | 7/2010 | Ziegler et al. |
| 7,832,048 | B2 | 11/2010 | Harwig et al. |
| 8,692,695 | B2 | 4/2014 | Fallon et al. |
| 8,892,251 | B1 | 11/2014 | Dooley et al. |
| 2002/0002751 | A1 | 1/2002 | Fisher |
| 2002/0011813 | A1 | 1/2002 | Koselka et al. |
| 2002/0016649 | A1 | 2/2002 | Jones |
| 2002/0120364 | A1 | 8/2002 | Colens |
| 2002/0175648 | A1 | 11/2002 | Erko et al. |
| 2003/0025472 | A1 | 2/2003 | Jones et al. |
| 2003/0229421 | A1 | 12/2003 | Chmura et al. |
| 2004/0020000 | A1 | 2/2004 | Jones |
| 2004/0031113 | A1 | 2/2004 | Wosewick et al. |
| 2004/1002000 | | 2/2004 | Jones |
| 2004/0049877 | A1 | 3/2004 | Jones et al. |
| 2004/0143930 | A1 | 7/2004 | Haegermarck |
| 2004/0187457 | A1 | 9/2004 | Colens |
| 2004/0207355 | A1 | 10/2004 | Jones et al. |
| 2004/0244138 | A1 | 12/2004 | Taylor et al. |
| 2005/0028316 | A1 | 2/2005 | Thomas et al. |
| 2005/0053912 | A1 | 3/2005 | Roth et al. |
| 2005/0067994 | A1 | 3/2005 | Jones et al. |
| 2005/0204717 | A1 | 9/2005 | Colens |
| 2005/0209736 | A1 | 9/2005 | Kawagoe |
| 2005/0217061 | A1 | 10/2005 | Reindle |
| 2005/0229340 | A1 | 10/2005 | Sawalski et al. |
| 2005/0278888 | A1 | 12/2005 | Reindle et al. |
| 2006/0009879 | A1 | 1/2006 | Lynch et al. |
| 2006/0085095 | A1 | 4/2006 | Reindle et al. |
| 2006/0123587 | A1 | 6/2006 | Parr et al. |
| 2006/0185690 | A1 | 8/2006 | Song et al. |
| 2006/0190134 | A1 | 8/2006 | Ziegler et al. |
| 2006/0207053 | A1 | 9/2006 | Beynon |
| 2006/0288519 | A1 | 12/2006 | Jaworski et al. |
| 2006/0293794 | A1 | 12/2006 | Harwig et al. |
| 2006/0293809 | A1 | 12/2006 | Harwig et al. |
| 2007/0016328 | A1 | 1/2007 | Ziegler et al. |
| 2007/0061040 | A1 | 3/2007 | Augenbraun et al. |
| 2007/0094836 | A1 | 5/2007 | Sepke et al. |
| 2007/0226943 | A1 | 10/2007 | Lenkiewicz et al. |
| 2007/0234492 | A1 | 10/2007 | Svendsen et al. |
| 2007/0266508 | A1 | 11/2007 | Jones et al. |
| 2008/0039974 | A1 | 2/2008 | Sandin et al. |
| 2008/0104783 | A1 | 5/2008 | Crawford et al. |
| 2008/0109126 | A1 | 5/2008 | Sandin et al. |
| 2008/0140255 | A1* | 6/2008 | Ziegler ..... A47L 5/14 700/245 |
| 2008/0155768 | A1 | 7/2008 | Ziegler et al. |
| 2008/0188984 | A1 | 8/2008 | Harwig et al. |
| 2008/0307590 | A1 | 12/2008 | Jones et al. |
| 2009/0133720 | A1 | 5/2009 | Van Den Bogert |
| 2009/0281661 | A1* | 11/2009 | Dooley ..... B60L 3/106 700/258 |
| 2009/0306822 | A1 | 12/2009 | Augenbraun et al. |
| 2010/0049365 | A1 | 2/2010 | Jones et al. |
| 2010/0257690 | A1 | 10/2010 | Jones et al. |
| 2010/0257691 | A1 | 10/2010 | Jones et al. |
| 2010/0263158 | A1 | 10/2010 | Jones et al. |

FOREIGN PATENT DOCUMENTS

| | | | | |
|---|---|---|---|---|
| KR | 10-2012-0042391 | * | 2/2013 | ..... A47L 9/28 |
| WO | 0191623 | | 12/2001 | |
| WO | 0191624 | | 12/2001 | |

OTHER PUBLICATIONS

Anderson et al., "The Journey Robot", Aug. 1, 2005, Southern Methodist University.

International Search Report and Written Opinion from corresponding International Application No. PCT/US2014/062096, dated Feb. 4, 2015.

Schur et al., "Robotics and Artificial Lifeforms: Stasis Logic," Feb. 5, 2007, ShursAstroPhotography.com.

* cited by examiner

AUTONOMOUS SURFACE CLEANING ROBOT

TECHNICAL FIELD

This disclosure relates to floor cleaning using an autonomous mobile robot.

BACKGROUND

Tiled floors and countertops routinely need cleaning, some of which entails scrubbing to remove dried in soils. Traditionally, wet mops are used to remove dirt and other dirty smears (e.g., dirt, oil, food, sauces, coffee, coffee grounds) from the surface of a floor. The fluid for wet cleaning can be distributed with the cleaning brush or pad or can be applied ahead of time. An autonomous robot is a robot that performs a specific task in unstructured environments without any guidance from a human. Several robots are available that can perform floor cleaning functions. An autonomous surface cleaning robot that can scrub and remove soils from surfaces traversed by the robot frees up an owner to perform other tasks or leisure.

SUMMARY

One aspect of the disclosure provides a mobile robot having a robot body, a drive system, and a cleaning assembly. The cleaning assembly includes a pad holder, a fluid applicator and a controller. The drive system supports the robot body to maneuver the robot across a floor surface. The cleaning assembly is disposed on the robot body and includes a pad holder, a fluid applicator and a controller in communication with the drive system and the cleaning system. The pad holder is configured to receive a cleaning pad having a center and lateral edges. The fluid applicator is configured to apply fluid to the floor surface. The controller controls the drive system and fluid applicator while executing a cleaning routine. The cleaning routine includes applying fluid to an area substantially equal to a footprint area of the robot, and returning the robot to the area in a movement pattern that moves the center and lateral edges of the cleaning pad separately through the area to moisten the cleaning pad with the applied fluid.

Implementations of the disclosure may include one or more of the following features. In some implementations, the cleaning routine further includes applying fluid to the surface at an initial volumetric flow rate to moisten the cleaning pad, the initial volumetric flow rate being relatively higher than a subsequent volumetric flow rate when the cleaning pad is moistened.

In some examples, the fluid applicator applies fluid to an area in front of the cleaning pad and in the direction of travel of the mobile robot. In some examples, the fluid is applied to an area the cleaning pad has occupied previously. In some examples, the area the cleaning pad 400 has occupied is recorded on a stored map that is accessible to the controller 150.

In some examples, the fluid applicator applies fluid to an area the robot has backed away from by a distance of at least one robot footprint length immediately prior to applying fluid. Executing the cleaning routine further comprises moving the cleaning pad in a birdsfoot motion forward and backward along a center trajectory, forward and backward along a trajectory to the left of and heading away from a starting point along the center trajectory, and forward and backward along a trajectory to the right of and heading away from a starting point along the center trajectory.

In some implementations, the drive system includes right and left drive wheels disposed on corresponding right and left portions of the robot body. A center of gravity of the robot is positioned forward of the drive wheels, causing a majority of an overall weight of the robot to be positioned over the pad holder. The overall weight of the robot may be distributed between the pad holder and the drive wheels at a ratio of 3 to 1. In some examples, the overall weight of the robot is between about 2 lbs. and about 5 lbs.

In some examples, the robot body and the pad holder both define substantially rectangular foot prints. Additionally or alternatively, the bottom surface of the pad holder may have a width of between about 60 millimeters and about 80 millimeters and a length of between about 180 millimeters and about 215 millimeters.

One aspect of the disclosure provides a mobile floor cleaning robot having a robot body, a drive system, a cleaning assembly, a pad holder, and a controller. The robot body defines a forward drive direction. The drive system supports the robot body to maneuver the robot across a floor surface. The cleaning assembly is disposed on the robot body and includes a pad holder, a reservoir, and a sprayer. The pad holder has a bottom surface configured to receive a cleaning pad and arranged to engage the floor surface. The reservoir is configured to hold a volume of fluid, and the sprayer, which is in fluid communication with the reservoir, is configured to spray the fluid along the forward drive direction forward of the pad holder. The controller communicates with both the drive system and the cleaning system and executes a cleaning routine. The controller executes a cleaning routine that allows the robot to drive in the forward drive direction a first distance to a first location and then drive in a reverse drive direction, opposite the forward drive direction, a second distance to a second location. The cleaning routine allows the robot to spray fluid on the floor surface from the second location, in the forward drive direction forward of the pad holder but rearward of the first location. After spraying fluid on the floor surface, the cleaning routine allows the robot to drive in alternating forward and reverse drive directions while smearing the cleaning pad along the floor surface.

Implementations of the disclosure may include one or more of the following features. In some implementations, the drive system includes right and left drive wheels disposed on corresponding right and left portions of the robot body. A center of gravity of the robot is positioned forward of the drive wheels, causing a majority of an overall weight of the robot to be positioned over the pad holder. The overall weight of the robot may be distributed between the pad holder and the drive wheels at a ratio of 3 to 1. In some examples, the overall weight of the robot is between about 2 lbs. and about 5 lbs. The drive system may include a drive body, which has forward and rearward portions, and right and left motors disposed on the drive body. The right and left drive wheels may be coupled to the corresponding right and left motors. The drive system may also include an arm that extends from the forward portion of the drive body. The arm is pivotally attachable to the robot body forward of the drive wheels to allow the drive wheels to move vertically with respect to the floor surface. The rearward portion of the drive body may define a slot sized to slidably receive a guide protrusion extending from the robot body.

In some examples, the robot body and the pad holder both define substantially rectangular foot prints. Additionally or alternatively, the bottom surface of the pad holder may have a width of between about 60 millimeters and about 80 millimeters and a length of between about 180 millimeters and about 215 millimeters.

The reservoir may hold a fluid volume of about 200 milliliters. Additionally or alternatively, the robot may include a vibration motor, or orbital oscillator, disposed on the top portion of the pad holder.

Another aspect of the disclosure provides a mobile floor cleaning robot that includes a robot body, a drive system, and a cleaning assembly. The robot body defines a forward drive direction. The drive system supports the robot body to maneuver the robot across a floor surface. The cleaning assembly is disposed on the robot body and includes a pad holder and an orbital oscillator. The pad holder is disposed forward of the drive wheels and has a top portion and a bottom portion. The bottom portion has a bottom surface arranged within between about ½ cm and about 1½ cm of the floor surface and receives a cleaning pad. The bottom surface of the pad holder includes at least 40 of a surface area of a footprint of the robot. The orbital oscillator is disposed on the top portion of the pad holder and has an orbital range less than 1 cm. The pad holder is configured to permit more than 80 percent of the orbital range of the orbital oscillator to be transmitted from the top of the held cleaning pad to the bottom surface of the held cleaning pad.

In some examples, the orbital range of the orbital oscillator is less than cm during at least part of a cleaning run. Additionally or alternatively, the robot may move the cleaning pad forward or backward while the cleaning pad is oscillating.

In some examples, the robot moves in a birdsfoot motion forward and backward along a center trajectory, forward and backward along a trajectory to the left of and heading away from a starting point along the center trajectory, and forward and backward along a trajectory to the right of and heading away from a starting point along the center trajectory.

In some examples, the cleaning pad has a top surface attached to the bottom surface of the pad holder and the top of the pad is substantially immobile relative to the oscillating pad holder.

In some examples, the overall weight of the robot is distributed between the pad holder and the drive wheels at a ratio of 3 to 1. The overall weight of the robot may be between about 2 lbs. and about 5 lbs.

In some examples, the robot body and the pad holder both define substantially rectangular foot prints. Additionally or alternatively, the bottom surface of the pad holder may have a width of between about 60 millimeters and about 80 millimeters and a length of between about 180 millimeters and about 215 millimeters.

The cleaning assembly may further include at least one post disposed on the top portion of the pad holder sized for receipt by a corresponding aperture defined by the robot body. The at least one post may have a cross sectional diameter varying in size along its length. Additionally or alternatively, the at least one post may include a vibration dampening material.

In some implementations, the cleaning assembly further includes a reservoir to hold a volume of fluid, and a sprayer in fluid communication with the reservoir. The sprayer is configured to spray the fluid along the forward drive direction forward of the pad holder. The reservoir may hold a fluid volume of about 200 milliliters.

The drive system may include a drive body, which has forward and rearward portions, and right and left motors disposed on the drive body. The right and left drive wheels are coupled to the corresponding right and left motors. The drive system may also include an arm that extends from the forward portion of the drive body. The arm is pivotally attachable to the robot body forward of the drive wheels to allow the drive wheels to move vertically with respect to the floor surface. The rearward portion of the drive body may define a slot sized to slidably receive a guide protrusion that extends from the robot body. In one example, the cleaning pad disposed on the bottom surface of the pad holder body absorbs about 90% of the fluid volume held in the reservoir. The cleaning pad has a thickness of between about 6.5 millimeters and about 8.5 millimeters, a width of between about 80 millimeters and about 68 millimeters, and a length of between about 200 millimeters and about 212 millimeters.

In some examples, a method includes driving a first distance in a forward drive direction defined by the robot to a first location, while moving a cleaning pad carried by the robot along a floor surface supporting the robot. The cleaning pad has a center area and lateral areas flanking the center area. The method further includes driving in a reverse drive direction opposite the forward drive direction, a second distance to a second location while moving the cleaning pad along the floor surface. The method also includes applying fluid to an area on the floor surface substantially equal to a footprint area of the robot and forward of the cleaning pad but rearward of the first location. The method further includes returning the robot to the area of applied fluid in a movement pattern that moves the center and lateral portions of the cleaning pad separately through the area to moisten the cleaning pad with the applied fluid 172.

In some examples, the method includes driving in a left drive direction or a right drive direction while driving in the alternating forward and reverse directions after spraying fluid on the floor surface. Applying fluid on the floor surface may include spraying fluid in multiple directions with respect to the forward drive direction. In some examples, the second distance is at least equal to the length of an footprint area of the robot.

In still yet another aspect of the disclosure, a method of operating a mobile floor cleaning robot includes driving a first distance in a forward drive direction defined by the robot to a first location while smearing a cleaning pad carried by the robot along a floor surface supporting the robot. The method includes driving in a reverse drive direction, opposite the forward drive direction, a second distance to a second location while smearing the cleaning pad along the floor surface. The method also includes spraying fluid on the floor surface in the forward drive direction forward of the cleaning pad but rearward of the first location. The method also includes driving in an alternating forward and reverse drive directions while smearing the cleaning pad along the floor surface after spraying fluid on the floor surface.

In some examples, the method includes spraying fluid on the floor surface while driving in the reverse direction or after having driven in the reverse drive direction the second distance. The method may include driving in a left drive direction or a right drive direction while driving in the alternating forward and reverse directions after spraying fluid on the floor surface. Spraying fluid on the floor surface may include spraying fluid in multiple directions with respect to the forward drive direction. In some examples, the second distance is greater than or equal to the first distance.

The mobile floor cleaning robot may include a robot body, a drive system, a pad holder, a reservoir, and a sprayer. The robot body defines the forward drive direction and has a bottom portion. The drive system supports the robot body and maneuvers the robot over the floor surface. The pad holder is disposed on the bottom portion of the robot body and holds the cleaning pad. The reservoir is housed by the robot body and holds a fluid (e.g., 200 ml). The sprayer, which is also housed by the robot body, is in fluid communication with the reservoir and sprays the fluid in the forward drive direction forward of the cleaning pad. The cleaning pad disposed on the bottom portion of the pad holder may absorb about 90% of the fluid contained in the reservoir. In some examples, the cleaning pad has a width of between about 80 millimeters and about 68 millimeters and a length of between about 200 millimeters and about 212 millimeters. The cleaning pad may have a thickness of between about 6.5 millimeters and about 8.5 millimeters.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
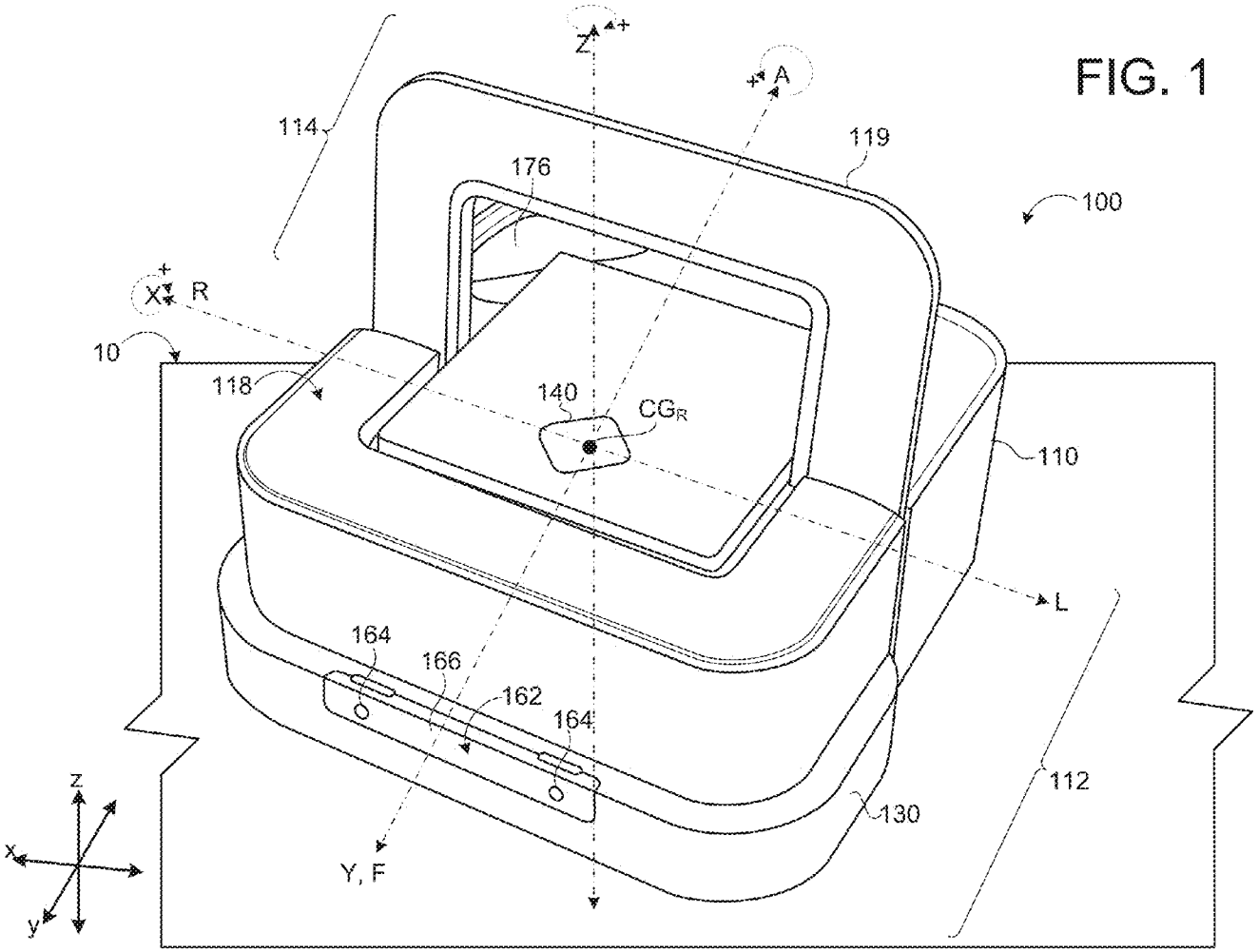
FIG. 1 is a perspective view of an exemplary autonomous mobile robot for cleaning.

An autonomous robot movably supported can navigate a floor surface. In some examples, the autonomous robot can clean a surface while traversing the surface. The robot can remove debris from the surface by agitating the debris and/or lifting the debris from the surface by spraying a liquid solution to the floor surface and/or scrubbing the debris from the floor surface.

Referring to FIGS. 1-12, in some implementations, a robot 100 includes a body 110 supported by a drive system 120 that can maneuver the robot 100 across the floor cleaning surface 10 based on a drive command having x, y, and 0 components, for example. As shown, the robot body 110 has a square shape. However, the body 110 may have other shapes, including but not limited to a circular shape, an oval shape, or a rectangular shape. The robot body 110 has a forward portion 112 and a rearward portion 114. The body 110 also includes a bottom portion 116 and a top portion 118.

The robot 100 can move across a cleaning surface 10 through various combinations of movements relative to three mutually perpendicular axes defined by the body 110: a transverse axis X, a fore-aft axis Y, and a central vertical axis Z. A forward drive direction along the fore-aft axis Y is designated F (sometimes referred to hereinafter as "forward"), and an aft drive direction along the fore-aft axis Y is designated A (sometimes referred to hereinafter as "rearward"). The transverse axis X extends between a right side R and a left side L of the robot 100 substantially along an axis defined by center points of the wheel modules 120*a*, 120*b*.

The robot 100 can tilt about the X axis. When the robot 100 tilts to the south position, it tilts toward the rearward portion 114 (sometimes referred to hereinafter as "pitched up"), and when the robot 100 tilts to the north position, it tilts towards the forward portion 112 (sometimes referred to hereinafter as "pitched down"). Additionally, the robot 100 tilts about the Y axis. The robot 100 may tilt to the east of the Y axis (sometimes referred to hereinafter as a "right roll"), or the robot 100 may tilt to the west of the Y axis (sometimes referred to hereinafter as a "left roll"). Therefore, a change in the tilt of the robot 100 about the X axis is a change in its pitch, and a change in the tilt of the robot 100 about the Y axis is a change in its roll. In addition, the robot 100 may either tilt to the right, i.e., an east position, or to the left i.e., a west position. In some examples, the robot tilts about the X axis and about the Y axis having tilt positions, such as northeast, northwest, southeast, and southwest. As the robot 100 is traversing a floor surface, the robot 100 may make a left or right turn about its Z axis (sometimes referred to hereinafter as a change in the yaw). A change in the yaw causes the robot 100 to make a left turn or a right turn while it is moving. Thus, the robot 100 may have a change in one or more of its pitch, roll, or yaw at the same time.

In some implementations, the forward portion 112 of the body 110 carries a bumper 130, which detects (e.g., via one or more sensors) one or more events in a drive path of the robot 100, for example, as the wheel modules 120*a*, 120*b* propel the robot 100 across the cleaning surface 10 during a cleaning routine. The robot 100 may respond to events (e.g., obstacles, cliffs, walls 20) detected by the bumper 130 by controlling the wheel modules 120*a*, 120*b* to maneuver the robot 100 in response to the event (e.g., away from an obstacle). While some sensors (not shown) are described herein as being arranged on the bumper 130, these sensors can additionally or alternatively be arranged at any of various different positions on the robot 100. The bumper 130 has a shape complementing the robot body 110 and extends forward the robot body 110 making the overall dimension of the forward portion 112 wider than the rearward portion 114 of the robot body (the robot as shown has a square shape).

A user interface 140 disposed on a top portion 118 of the body 110 receives one or more user commands and/or displays a status of the robot 100. The user interface 140 is in communication with a robot controller 150 carried by the robot 100 such that one or more commands received by the user interface 140 can initiate execution of a cleaning routine by the robot 100. In some examples, the user interface 140 includes a power button, which allows a user to turn on/off the robot 100. In addition, the user interface 140 may include a release mechanism to release a removable and/or disposable cleaning element, such as a cleaning pad 400, attached to the robot body 110 over a trash can without the user touching the pad 400. The release mechanism may be a release button (not shown) or a lever (not shown) that a user can pull or push allowing the robot body 110 to release the cleaning pad 400 from the pad holder assembly 190. Additionally or alternatively, for a cleaning robot, an open button (not shown) may be part of the user interface 140. The open button opens a door to a reservoir 170 allowing a user to fill/empty water. The controller 150 includes a computing processor 152 (e.g., central processing unit) in communication with non-transitory memory 154 (e.g., a hard disk, flash memory, random-access memory).

In some examples, a handle 119 is disposed on the top portion 118 of the body 110. The handle 119 may pivotally flip along the transverse axis X of the robot body 110. In a closed position, the handle 119 is disposed substantially parallel to the top portion 118 of the body 110. In an open position, the handle 119 is disposed substantially perpendicular to the top portion 118 of the body 110. The handle 119 may include a friction lock (not shown) in the open position to keep the robot stable when a user is carrying the robot 100 or when the user is inserting or removing the battery 102 or changing the cleaning pad 400.

Figure 5:
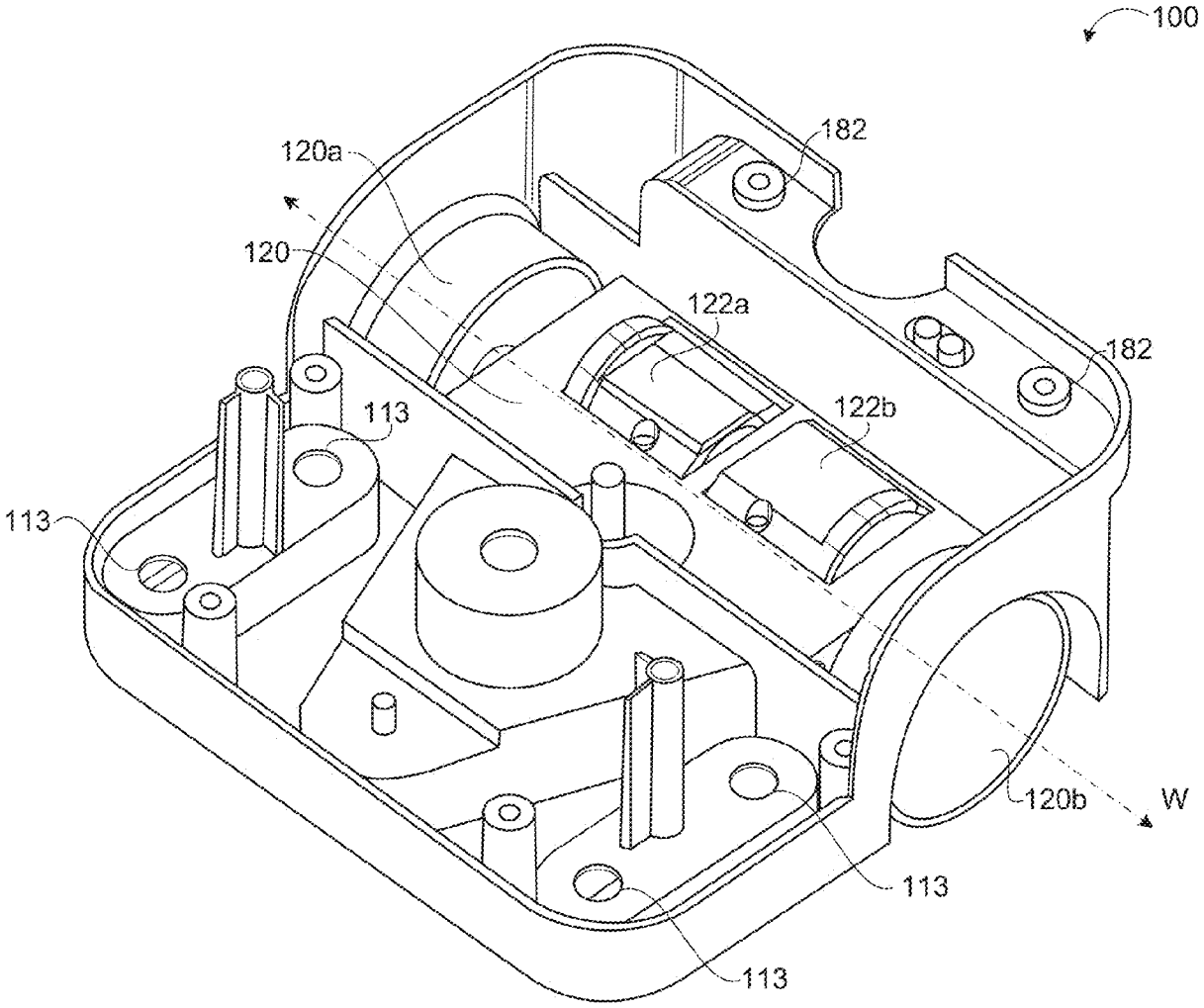
FIG. 5 is a perspective view of the exemplary autonomous mobile robot of FIG. 1.
Figure 6:
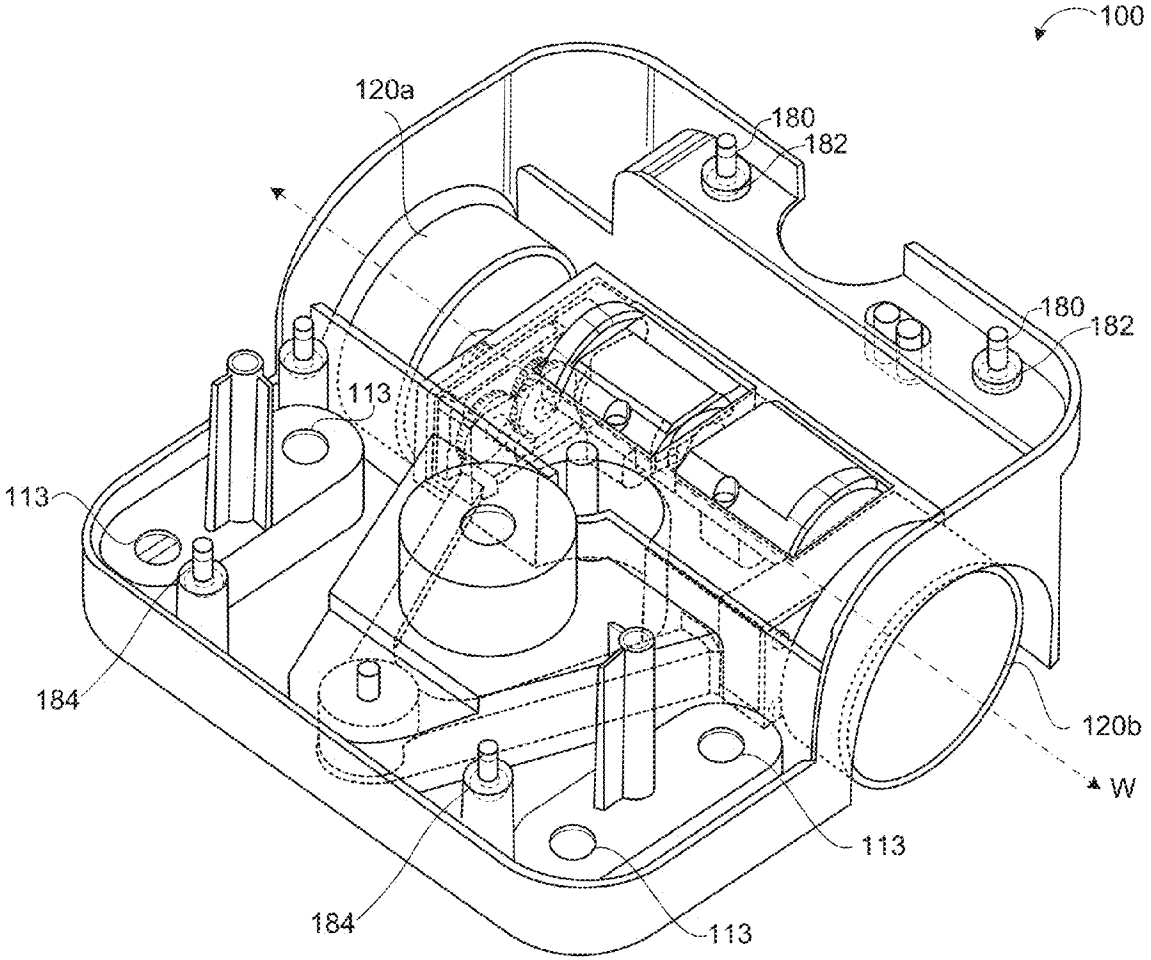
FIG. 6 is a perspective view of the exemplary autonomous mobile robot of FIG. 1.

Referring to FIGS. 5 and 6, the robot body 110 may support a rear spring 180 for supporting the top portion 118 of the robot body 110. The rear spring 180 levels the robot body 110 parallel to the floor and allows for compression of the robot 100 if weight is applied on its top portion 118. If a person steps on the upper portion 118 of the robot 100, the rear springs 180 and the wheel springs (not shown) compress and allow the bottom portion 116 of the robot body 110 to rest on the floor surface. The rear springs 180 have a stop mechanism 182 that refrains the springs 180 from further compression after a predetermined threshold. The mechanism protects the drive assembly 120 from damage from an external application of force, such as a person stepping on the robot 100. The rear spring 180 may include a pre-bent strip of spring steel bent down to support the spring at a pre-loaded position. In some examples, the robot body 110 includes front springs 184 having the same features as the rear springs 180.

Figure 7:
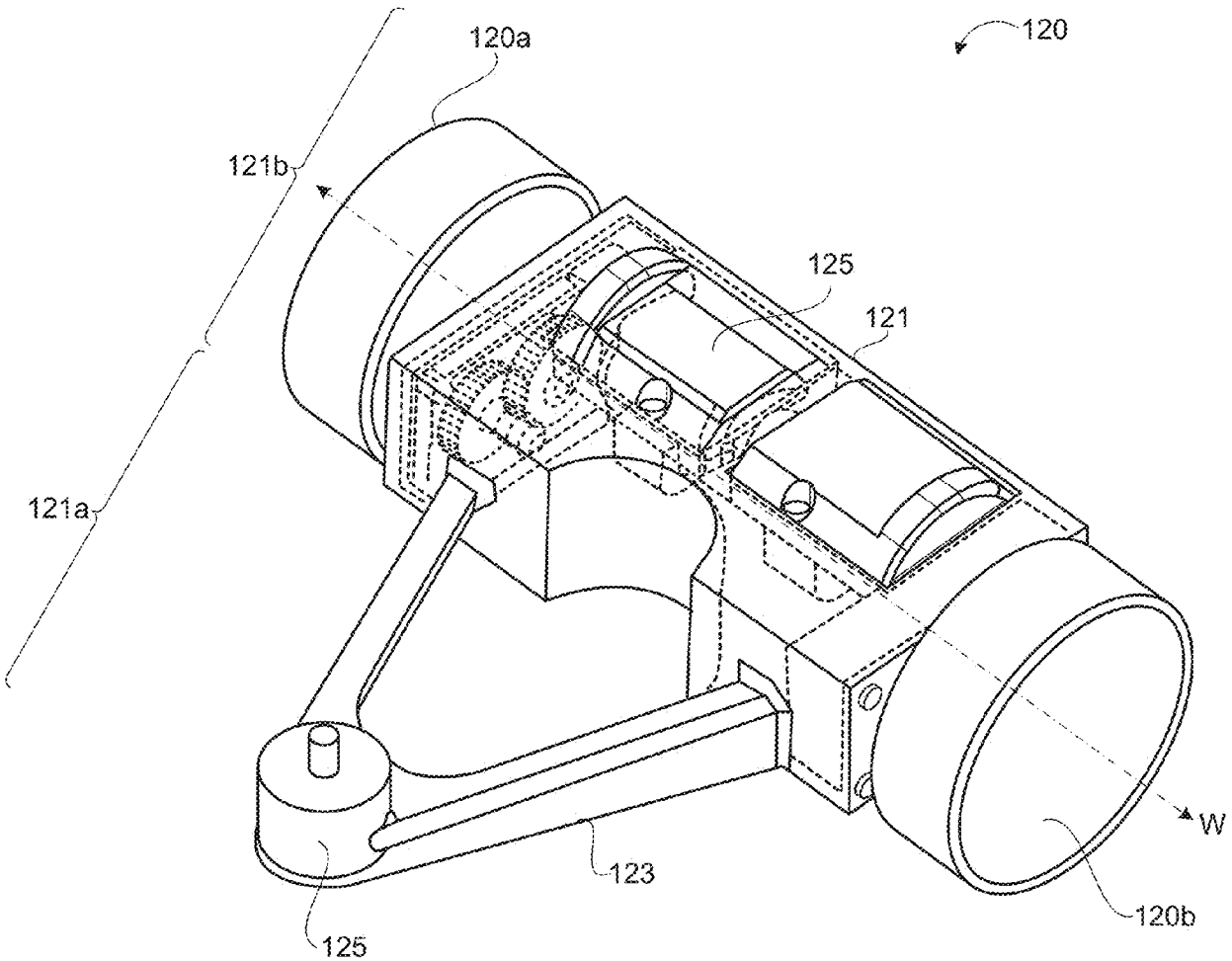
FIG. 7 is a perspective view of the drive system of the exemplary autonomous mobile robot of FIG. 1.
Figure 8:
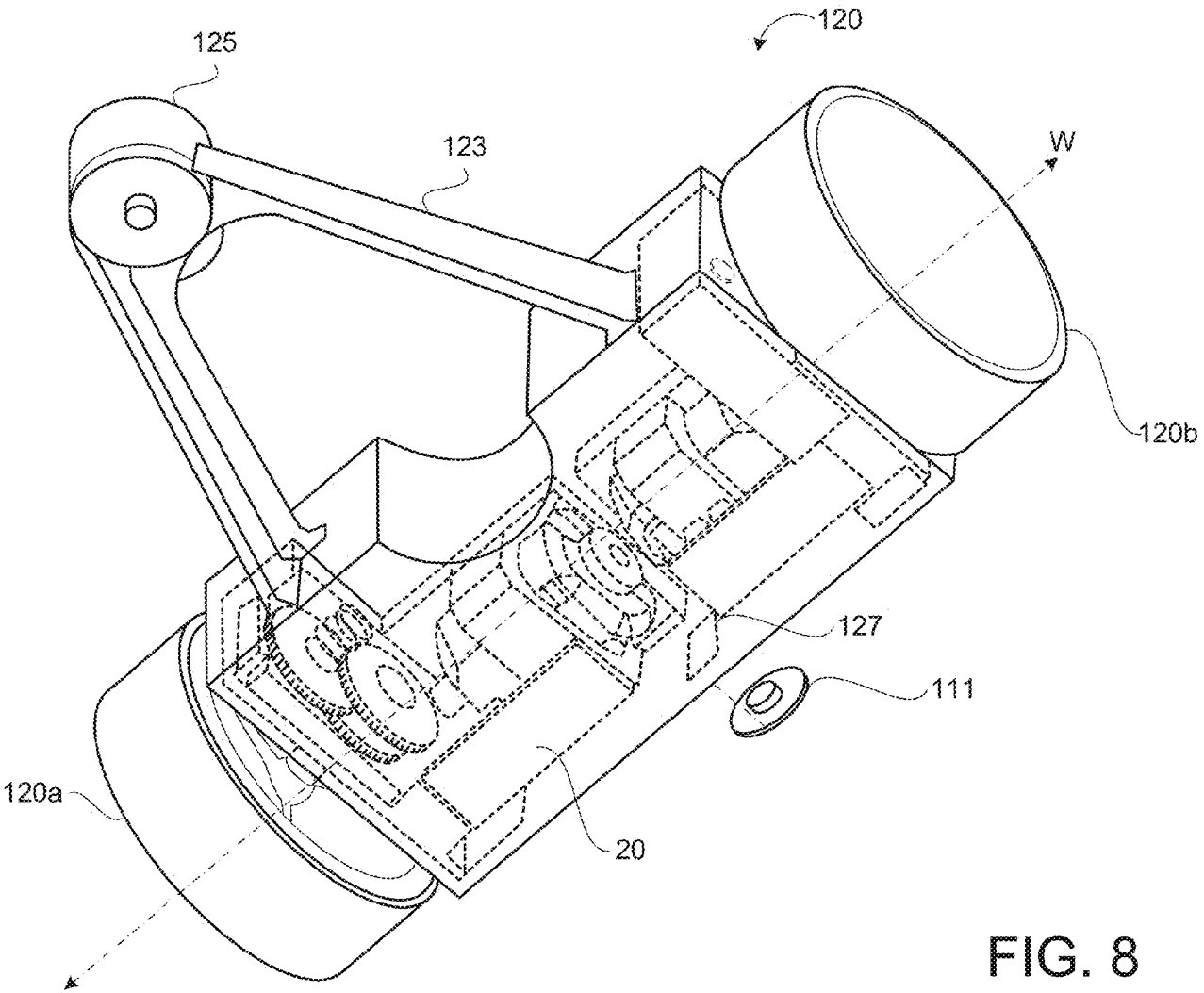
FIG. 8 is a perspective view of the drive system of the exemplary autonomous mobile robot of FIG. 1.

Referring to FIGS. 7 and 8, the drive system 120 includes right and left driven wheel modules 120*a*, 120*b* housed by a drive housing 121 having forward and rearward portions 121*a*, 121*b*. The wheel modules 120*a*, 120*b* are substantially opposed along a transverse axis X defined by the body 110 and include respective drive motors 122*a*, 122*b* driving respective wheels 124*a*, 124*b* also housed by the drive housing 121. The drive motors 122*a*, 122*b* may releasably connect to the drive housing 121 (e.g., via fasteners or tool-less connections) with the drive motors 122*a*, 122*b* optionally positioned substantially adjacent the respective wheels 124*a*, 124*b*. The wheel modules 120*a*, 120*b* can be releasably attached to the drive housing 121 and forced into engagement with the cleaning surface 10 by respective springs. In some examples, the wheels 124*a*, 124*b* are releasably supported by the drive housing 121. The wheels 124*a*, 124*b* may have a biased-to-drop suspension system, which improves traction of the wheel modules 120*a*, 120*b* over slippery floors (e.g., hardwood, wet floors). The wheels 124*a*, 124*b* define a wheel axis W extending from the center of one wheel to the center of the other wheel and substantially parallel to the floor surface 10. The wheels 124*a*, 124*b* rotate about the wheel axis W when the robot 100 is traversing a floor surface 10. The wheels 124*a*, 124*b* have enough traction to overcome the friction between the cleaning pad 400 and the floor surface 10. In some examples, the friction between the cleaning pad 400 and the floor surface 10 is different when the cleaning pad 400 is dry than when the cleaning pad 400 has absorbed the cleaning fluid 172. The robot 100 may increase the volumetric flow rate of dispensing of the cleaning fluid 172 and/or the traction force to overcome the increase of friction between the cleaning pad 400 and the floor surface 10. In some implementation, the robot 100 applies cleaning fluid 172 at an initial volumetric flow rate $V_i$ initially, while the cleaning pad 400 is dry or mostly dry. As the cleaning pad 400 absorbs cleaning fluid 172 and friction between the cleaning pad 400 and the floor surface 10 decreases, the robot 100 applies fluid at a second volumetric flow rate $V_f$ that is lower than the initial volumetric flow rate $V_i$ ($V_i > V_f$).

An arm 123 is attached to the forward portion of the drive housing 121. The arm 123 is pivotally attachable to the robot body 110 forward of the drive wheels 124*a*, 124*b* to allow the drive housing 121 to move vertically with respect to the floor surface 10 via a rubber pivot mount 125. The rearward portion 121*b* of the drive housing 121 defines a slot 127. The slot 127 is sized to slidably receive a guide protrusion 111 defined by or disposed on the robot body 110. The slot 127 allows the robot body 110 to move with respect to the drive system 120 if vertical pressure is applied to the robot body 110 and the rear springs 180 are compressed due to the pressure. The robot 100 may include a caster wheel (not shown) disposed to support a rearward portion 114 of the robot body 110.

Referring back to FIG. 3, the robot body 110 supports a power source 102 (e.g., a battery) for powering any electrical components of the robot 100. In some examples, the power source 102 includes swing out prongs (not shown) to allow direct plug into the wall outlets. The robot 100 may include (e.g., on the top portion 118 visible to the user) an indicator for indicating when the power source 102 is ready to be used or when it is empty and needs to be recharged. In some examples, the power source 102 may be releasably connected to the robot body 110 and may be charged separately without being connected to the robot body 110. In some examples, the power source 102 is releasably connected to the robot body 110 and is insertably mated into a universal plug adapter (not show) for use across a range of voltages, for example 110-220V. The power source 102 may include one or more rechargeable batteries (e.g., nickel-metal hydride battery (NiMH)). In some implementations, the power source 102 is sized to a certain weight or includes metal weight plates to provide stability to the rearward portion 114 of the robot body 110 to achieve a specific weight ratio between the drive wheels 124*a*, 124*b* and the cleaning pad 400.

The robot controller 150 (FIGS. 16 and 17), executing a control system 210, may execute behaviors 300 that cause the robot 100 to take an action, such as maneuver in a wall following manner, a floor scrubbing manner, or changing its direction of travel when an obstacle (e.g., chair, table, sofa, etc.) is detected. The robot controller 150 can maneuver the robot 100 in any direction across the cleaning surface 10 by independently controlling the rotational speed and direction of each wheel module 120*a*, 120*b*. For example, the robot controller 150 can maneuver the robot 100 in the forward F, reverse (aft) A, right R, and left L directions.

Figure 12:
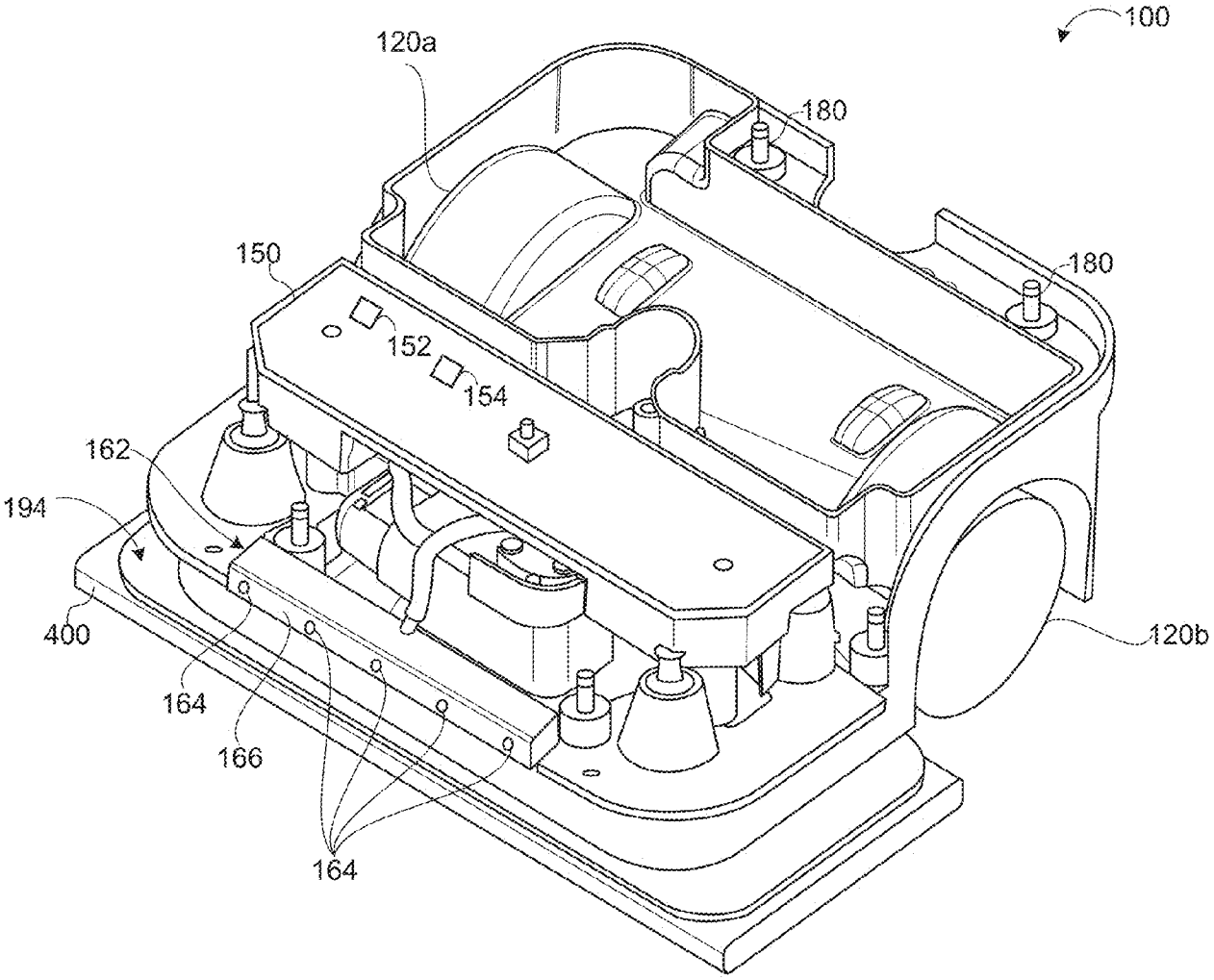
FIG. 12 is a perspective view of the exemplary autonomous mobile robot of FIG. 1.

The robot 100 may include a cleaning system 160 (FIG. 15) for cleaning or treating a floor surface 10. As shown in FIG. 12, the cleaning system 160 may include a fluid applicator 162 that extends along the transverse axis X and dispenses cleaning fluid 172 onto the floor surface 10. The fluid applicator 162 may be a sprayer having at least one nozzle 164 that distributes fluid 172 over the floor surface 10. In some examples, the nozzle 164 sprays forward and downward to cover one robot length l and/or one robot width w in front of the robot 100. The outside lengthwise edges of the robot 100 and the outside widthwise edges of the robot 100 bound a footprint area AF of the robot 100, or the planar surface area occupied by the robot 100. In other implementations, the outside periphery and/or circumference of a non-rectangular robot 100 bounds the footprint area AF of the robot 100.

In some implementations, the robot 100 only applies fluid to areas of the floor surface 10 that the robot 100 has already traversed. In one example, the fluid applicator 162 has multiple nozzles 164 each configured to spray the fluid 172 in a direction different than another nozzle 164. The fluid applicator 162 may apply fluid 172 downward rather than outward, dripping or spraying fluid 172 directly in front of the robot 100. In some examples, the fluid applicator 162 is a microfiber cloth or strip, a fluid dispersion brush, or a sprayer.

Figure 13B:
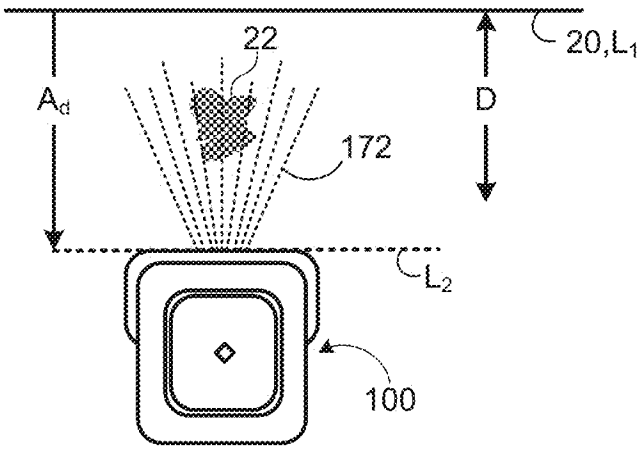
FIGS. 13A and 13B are top views of an exemplary autonomous mobile robot as it sprays a floor surface with a fluid.
Figure 13A:
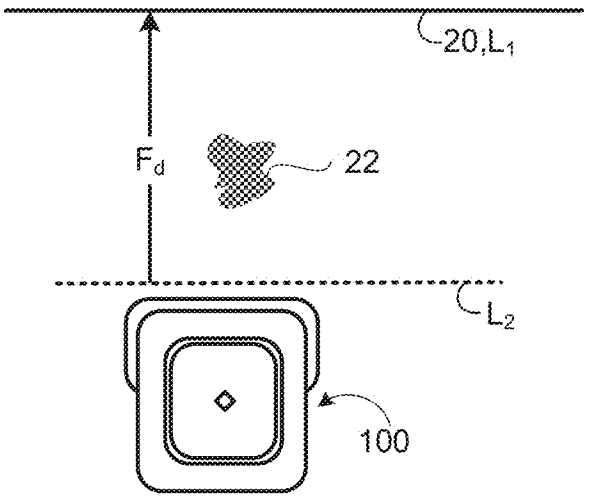

Referring to FIGS. 13A-13E, in some implementations, the robot 100 may execute a cleaning behavior 300*a* (FIG. 16) by moving in a forward direction F toward an obstacle 20, followed by moving in a backward or reverse direction A. As indicated in FIGS. 13A and 13B, the robot 100 may drive in a forward drive direction a first distance $F_d$ to a first location $L_1$. As the robot 100 moves backwards a second distance $A_d$ to a second location $L_2$, the nozzle 164 sprays fluid 172 onto the floor surface 10 in a forward and/or downward direction in front of the robot 100 after the robot 100 has moved at least a distance D across an area of the floor surface 10 that was already traversed in the forward drive direction F. In one example, the fluid 172 is applied to an area substantially equal to the area footprint AF of the robot 100. Because distance D is the distance spanning at least the length of the robot 100, the robot 100 determines that it is clear floor surface 10 unoccupied by furniture, walls 20, cliffs, carpets or other surfaces or obstacles onto which cleaning fluid 172 would be applied if the robot 100 had not already verified the presence of a clear floor surface 10 for receiving cleaning fluid. By moving in a forward direction F and then backing up prior to applying cleaning fluid 172, the robot 100 identifies boundaries, such as a flooring changes and walls, and prevents fluid damage to those items.

Figure 2:
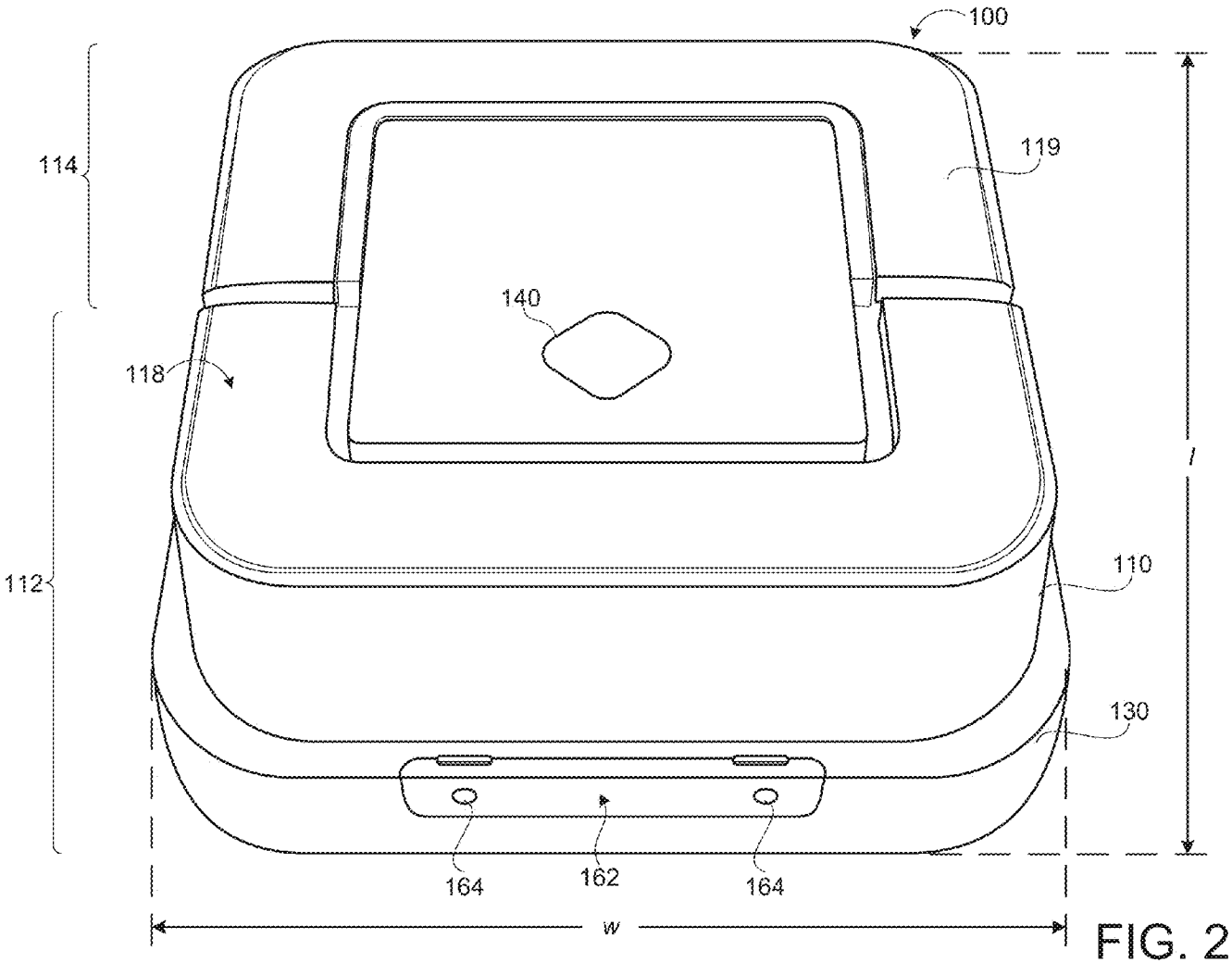
FIG. 2 is a perspective view of the exemplary autonomous mobile robot of FIG. 1.
Figure 11:
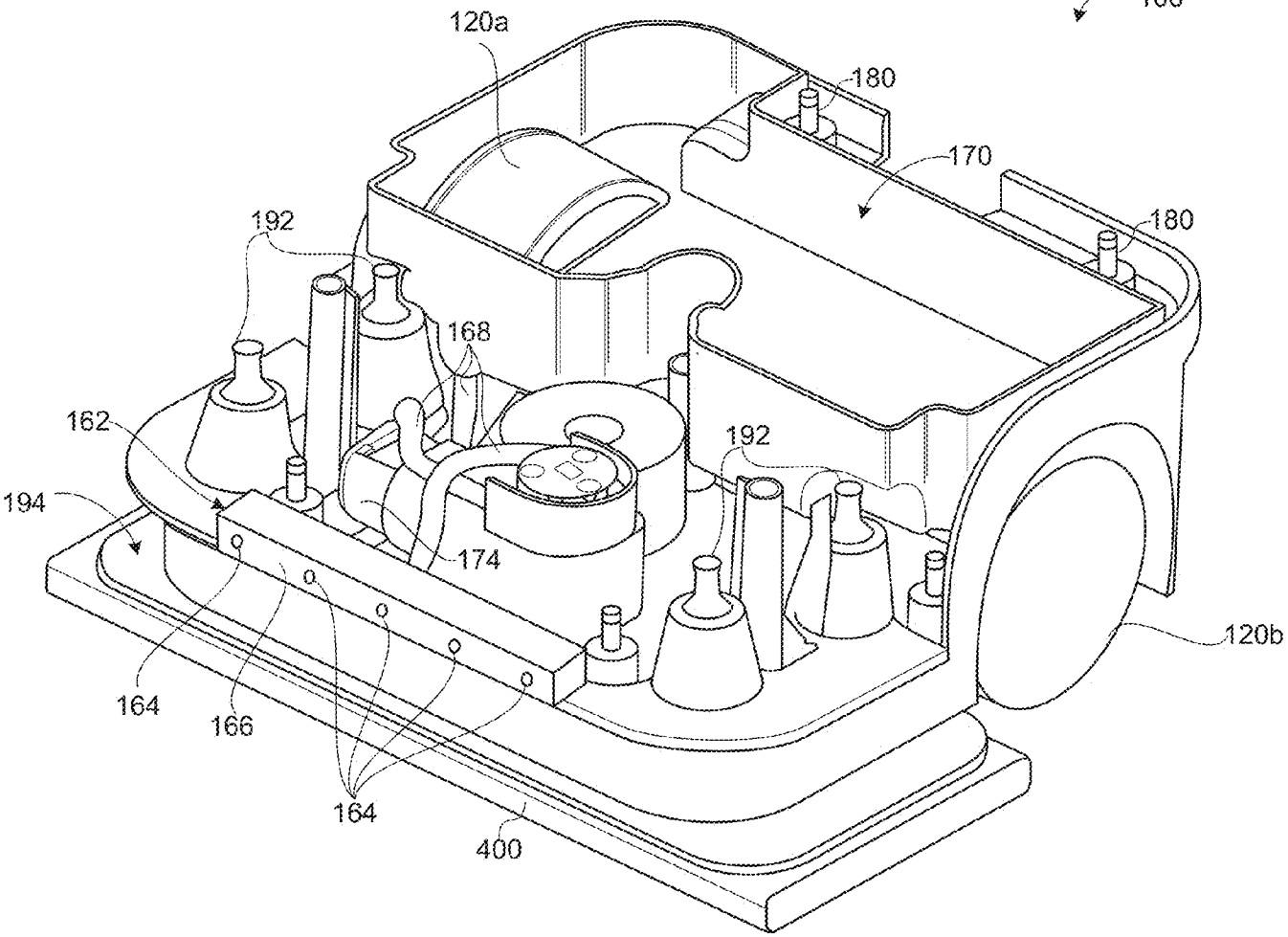
FIG. 11 is a perspective view of the exemplary autonomous mobile robot of FIG. 1.

As shown in FIGS. 2 and 11, in some examples, the fluid applicator 162 is a sprayer 162 that includes at least two nozzles 164, each spraying the fluid in a fan-like shape and distributing the fluid 172 evenly across the floor surface 10. The fluid applicator 162 may include a front cover plate 166 that houses the nozzles 164. The front cover plate 166 may be removed for cleaning or replacing the nozzles 164.

Figure 13C:
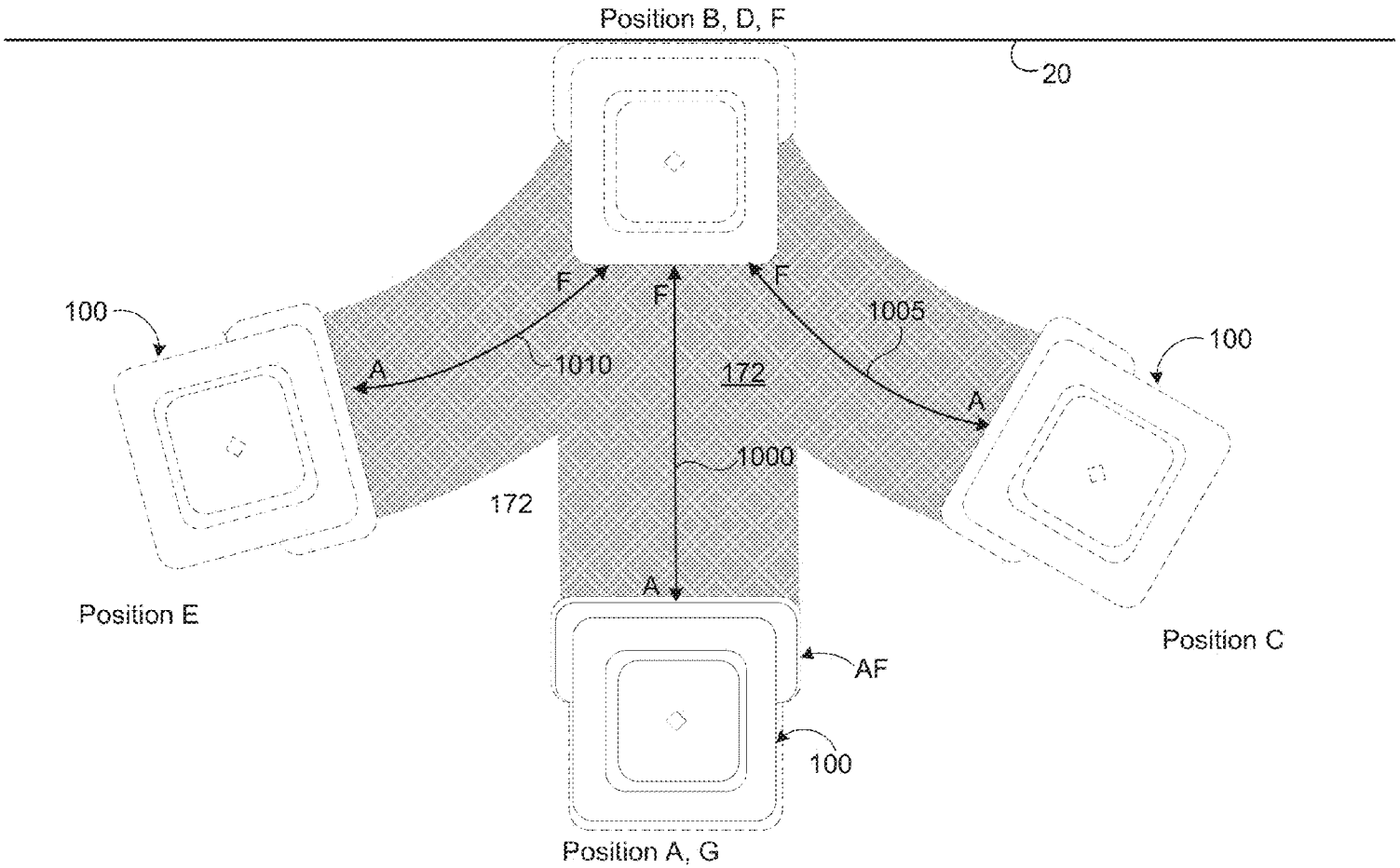
FIG. 13C is a top view of an exemplary autonomous mobile robot as it scrubs a floor surface.
Figure 13D:
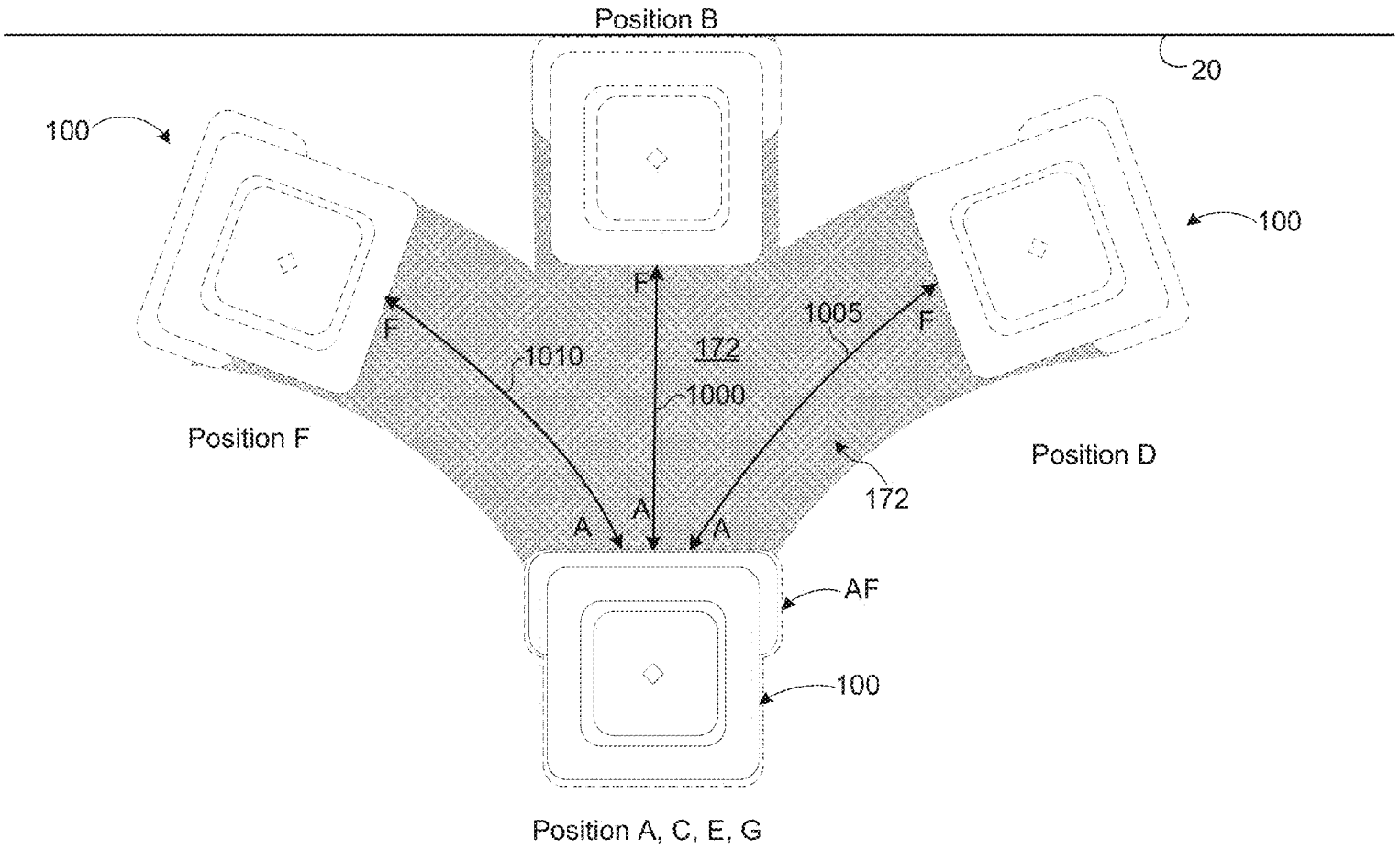
FIG. 13D is a top view of an exemplary autonomous mobile robot as it scrubs a floor surface.
Figure 13E:
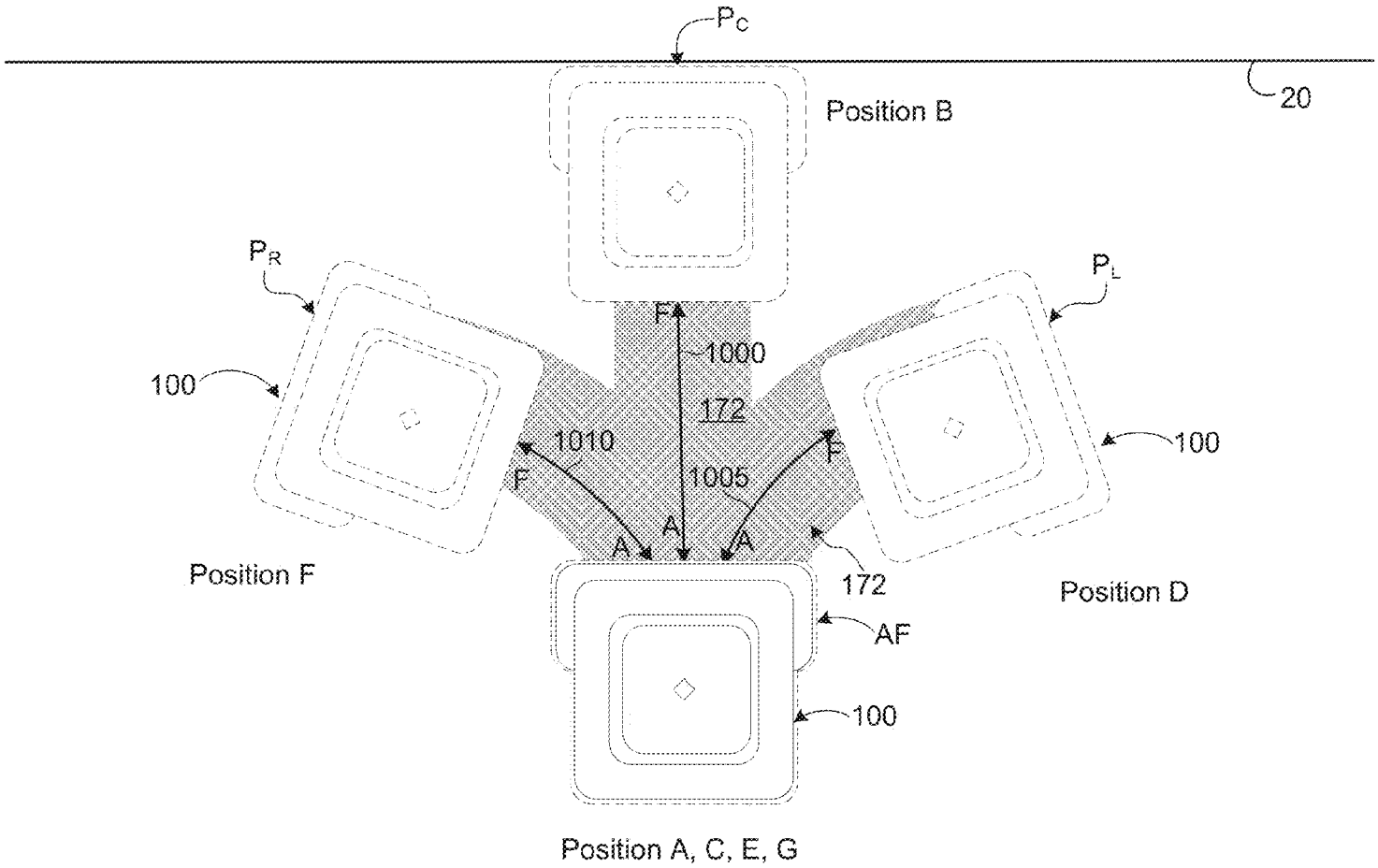
FIG. 13E is a top view of an exemplary autonomous mobile robot as it scrubs a floor surface.

Referring to FIGS. 13C-13E, in some examples, the robot 100 may drive back and forth to cover a specific portion of the floor surface 10, wetting the cleaning pad 400 at the start of a cleaning run and/or scrubbing the floor surface 10. As the robot 100 drives back and forth, it cleans the area it is traversing and therefore provides a thorough scrub to the floor surface 10.

In some examples, the fluid applicator 162 applies fluid 172 to an area in front of the cleaning pad 400 and in the direction of travel (e.g., forward direction F) of the mobile robot 100. In some examples, the fluid 172 is applied to an area the cleaning pad 400 has previously occupied. In some examples, the area the cleaning pad 400 has occupied is recorded on a stored map that is accessible to the controller 150.

In some examples, the robot 100 knows where it has been based on storing its coverage locations on a map stored on the non-transitory-memory 154 of the robot 100 or on an external storage medium accessible by the robot 100 through wired or wireless means during a cleaning run. The robot 100 sensors 510 (FIG. 15) may include a camera and/or one or more ranging lasers for building a map of a space. In some examples, the robot controller 150 uses the map of walls, furniture, flooring changes and other obstacles to position and pose the robot 100 at locations far enough away from obstacles and/or flooring changes prior to the application of cleaning fluid 172. This has the advantage of applying fluid 172 to areas of floor surface 10 having no known obstacles thereon.

In some examples, the robot 100 moves in a back and forth motion to moisten the cleaning pad 400 and/or scrub the floor surface 10 to which fluid 172 has been applied. The robot 100 may move in a birdsfoot pattern through the footprint area AF on the floor surface 10 to which fluid 172 has been applied. As depict, in some implementations, the birdsfoot cleaning routine involves moving the robot 100 in forward direction F and a backward or reverse direction A along a center trajectory 1000 and in forward direction F and a backward direction A along left 1010 and right 1005 trajectories. In some examples, the left trajectory 1010 and the right trajectory 1005 are arcuate trajectories that extend outward in an arc from a starting point along the center trajectory 1000. The left trajectory 1010 and the right trajectory 1005 may be straight line trajectories that extend outward in a straight line from the center trajectory 1000.

FIGS. 13C and 13E depict two birdsfoot trajectories. In the example of FIG. 13C, the robot 100 moves in a forward direction F from Position A along the center trajectory 1000 until it encounters a wall 20 and triggers a sensor 510, such as a bump sensor, at Position B. The robot 100 then moves in a backward direction A along the center trajectory to a distance equal to or greater than the distance to be covered by fluid application. For example, the robot 100 moves backward along the center trajectory 1000 by at least one robot length l to Position G, which may be the same position as Position A. The robot 100 applies fluid 172 to an area substantially equal to the footprint area AF of the robot 100 and returns to the wall 20, the cleaning pad 400 passing through the fluid 172 and cleaning the floor surface 10. From position B, the robot 100 retracts either along a left trajectory 1010 or a right trajectory 1005 before returning to Position B and covering the remaining trajectory. Each time the robot 100 moves forward and backward along the center trajectory 1000, left trajectory 1010 and right trajectory 1005, the cleaning pad 400 passes through the applied fluid 172, scrubbing dirt, debris and other particulate matter from the floor surface 10 to which the fluid 172 is applied and absorbing the dirty fluid into the cleaning pad 400 and away from the floor surface 10. The scrubbing motion of the moistened pad combined with the solvent characteristics of the cleaning fluid 172 breaks down and loosens dried stains and dirt. The cleaning fluid 172 applied by the robot 100 suspends loosened debris such that the cleaning pad 400 absorbs the suspended debris and wicks it away from the floor surface 10.

In the example of FIG. 13D, the robot 100 similarly moves from a starting position, Position A, through applied fluid 172, along a center trajectory 1000 to a wall position, Position B. The robot 100 backs off of the wall 20 along the center trajectory 1000 to Position C, which may be the same position as Position A, before covering left and right trajectories 1010, 1005, extending to positions D and F, with the cleaning fluid 172 distributed along the trajectories 1010, 1005 by the cleaning pad 400. In one example, each time the robot 100 extends along a trajectory outward from the center trajectory 1000, the robot 100 returns to a position along the center trajectory as indicated by Positions A, C, E and G, as depicted in FIG. 13D. In some implementations, the robot 100 may vary the sequence of backward direction A movements and forward direction F movements along one or more distinct trajectories to move the cleaning pad 400 and cleaning fluid 172 in an effective and efficient coverage pattern across the floor surface 10.

Figure 9A:
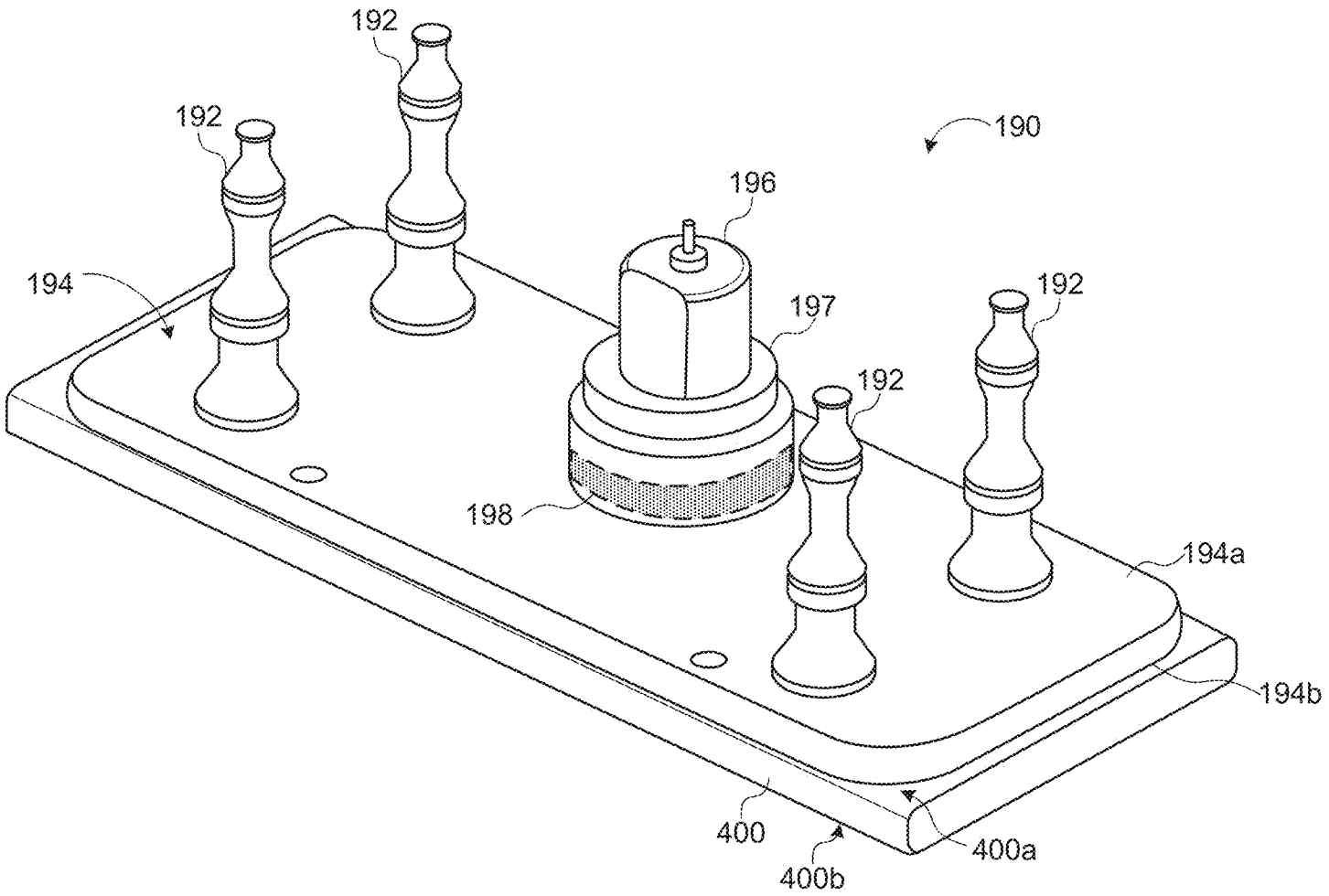
FIG. 9A is a perspective view of the pad holder assembly of the exemplary autonomous mobile robot of FIG. 1.
Figure 9B:
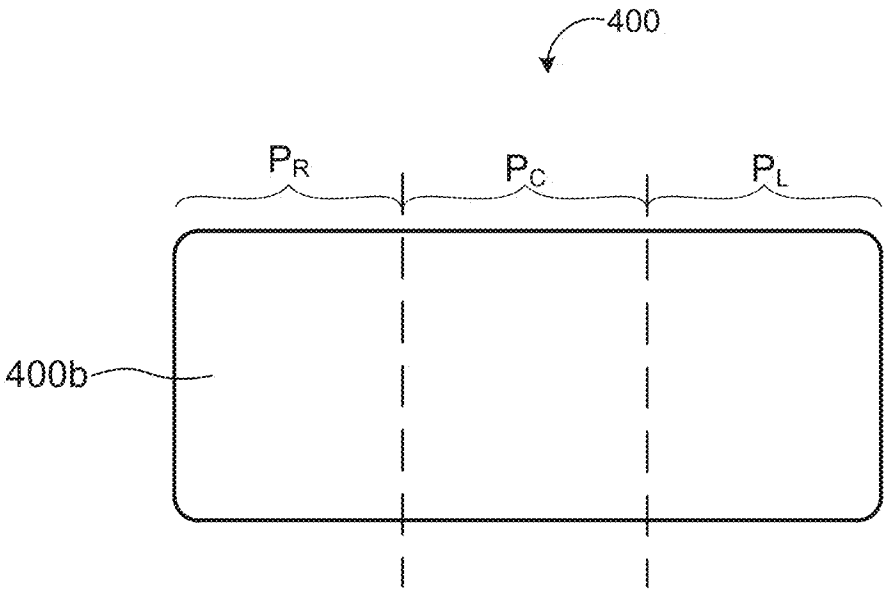
FIG. 9B is a bottom view of the cleaning pad of the exemplary autonomous mobile robot of FIG. 1.

In some examples, the robot 100 may move in a birdsfoot coverage pattern to moisten all portions of the cleaning pad 400 upon starting a cleaning run. As depicted in FIG. 9B, the bottom surface 400*b* of the cleaning pad 400 has a center area $P_C$ and right and left lateral edge areas $P_R$ and $P_L$. When the robot 100 starts a cleaning run, or cleaning routine, the cleaning pad is dry 400 and needs to be moistened to reduce friction and also to spread cleaning fluid 172 along the floor surface 10 to scrub debris therefrom. The robot 100 therefore applies fluid at a higher volumetric flow rate initially at the start of a cleaning run such that the cleaning pad 400 is readily moistened. As FIG. 13E depicts, in some examples, at the start of a cleaning run, the robot 100 drives the cleaning pad 400 through applied fluid 172 such that the center area $P_C$ of the bottom surface 400*b* of the cleaning pad 400 and the left and right lateral edge areas $P_R$ and $P_L$ of the cleaning pad 400 each pass through the applied fluid separately, thereby moistening the entire cleaning pad 400 along the entire bottom surface 400*b* of the cleaning pad 400 in contact with the floor surface 10.

In the example of FIG. 13E, the robot 100 moves in a forward direction F and then backward direction A along a center trajectory 1000, passing the center of the pad 400 through the applied fluid 172. The robot 100 then drives in a forward direction F and backward direction A along a right trajectory 1005, passing the left lateral area $P_L$ of the cleaning pad 400 through the applied fluid 172. The robot 100 then drives in a forward direction F and backward direction A along a left trajectory 1010, passing the right lateral area $P_R$ of the cleaning pad 400 through the applied fluid 172. At the start of the cleaning run, the robot applies fluid 172 at a relatively high initial volumetric flow rate $V_i$, applying a larger quantity of fluid 172 to the surface 10 to moisten the cleaning pad 400 quickly. Once the cleaning pad 400 is moistened, the robot 100 continues its cleaning run and subsequently applies fluid 172 at a second volumetric flow rate $V_f$. This second volumetric flow rate $V_f$ is relatively lower than the initial flow rate $V_i$ at the start of the cleaning run because the cleaning pad 400 is already moistened and effectively moves cleaning fluid across the surface 10 as it scrubs. The robot 100 adjusts the volumetric flow rate V such that a cleaning pad 400 of specified dimensions is moistened on the exterior (i.e. the bottom surface 400*b*) without being fully wetted to capacity internally. The bottom surface 400*b* of the cleaning pad 400 is initially moistened without the absorbent interior of the pad 400 being water logged such that the cleaning pad 400 remains fully absorbent for the remainder of the cleaning run.

The back and forth movement of the robot 100 breaks down stains 22 on the floor surface 10. The broken down stains 22 are then absorbed by the cleaning pad 400. In some examples, the cleaning pad 400 picks up enough of the sprayed fluid 172 to avoid uneven streaks. In some examples, the cleaning pad 400 leaves a residue of the solution to provide a nice sheen look on the floor surface 10 being scrubbed. In some examples, the fluid 172 contains antibacterial solution; therefore, a thin layer of residue is purposely not absorbed by the cleaning pad 400 to allow the fluid 172 to kill a higher percentage of germs.

Figure 3:
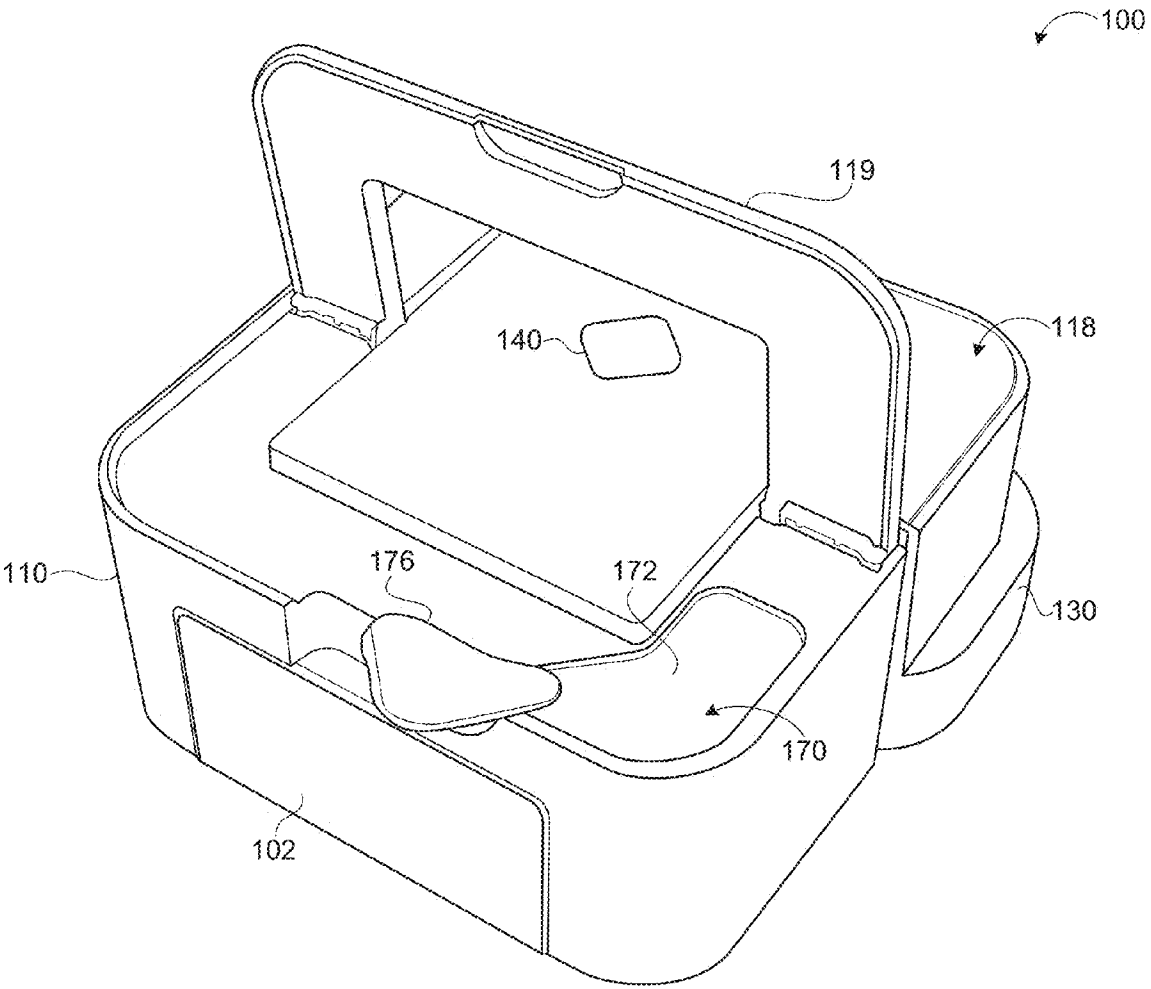
FIG. 3 is a perspective view of the exemplary autonomous mobile robot of FIG. 1.

Referring to FIGS. 3 and 11, a reservoir 170 housed by the robot body 110 holds the fluid 172 (i.e. cleaning solution) and is connected to the nozzle 164 by a tube 168. The reservoir 170 may be housed in the rearward portion 114 of the robot 100. The cleaning system 160 may also include a pump motor 174 for transferring the fluid 172 from the reservoir 170 to the nozzle 164 via the tubes 168. The tube 168 runs from the reservoir 170 through the pump motor 174 and ends at the fluid applicator 162. The tube 168 connects to the reservoir 170 at a lowest point in the reservoir 170 to allow draining of almost all the fluid 172 in the reservoir 170. In some examples, the pump motor 174 is a peristaltic pump having a rotor with a number of rollers attached to an external circumference of the rotor and compressing the flexible tube 168. As the rotor turns, the part of the tube 168 being compressed is pinched closed, which leads to forcing the fluid 172 to be pumped and moved through the tube 168.

The reservoir 170 may hold a fluid 172 having a volume between 200 ml and 250 ml or more. The reservoir 170 may have a semi-transparent portion or may be fully transparent to allow a user to know how much fluid 172 is left in the reservoir 170. The transparent portion may include an indication that allows the user to identify the volume of fluid 172 remaining and if the reservoir 170 needs to be refilled. In some examples, where the robot 100 carries a cleaning pad 400, the cleaning pad 400 may absorb 85% to 95% of the fluid volume contained in the reservoir 170.

The reservoir 170 includes a cap 176 for allowing a user to empty or fill the reservoir 170 with fluid 172. The cap 176 may be made of rubber to improve sealing the reservoir 170 after being filled with fluid 172. The cap 176 may include a retainer post (not shown) that connects the cap 176 to the robot 100 when a user opens the cap 176 to fill the tank 170. In some examples, an air release valve (not shown) is incorporated into the cap 176 to allow air to enter the reservoir 170 as the pump draws out cleaning solution to off-set the void left. In some examples, the air release valve is a tubular opening with a soft undercut flap molded into the cap 176. The handle 119 may fully or substantially cover the cap 176, in its closed position.

Referring to FIGS. 4 and 9-12, the robot 100 may include a pad holder assembly 190 disposed on the bottom portion 116 of the robot body 110 and supported by the robot body 110. The pad holder assembly 190 holds a cleaning pad 400. The pad holder assembly 190 includes a pad holder body 194 having a top portion 194*a* and a bottom portion 194*b*. The bottom portion 194*b* may be arranged within between about ½ cm and about 1½ cm of the floor surface. In some examples, the bottom portion 194*b* makes up at least 40% of a surface area of a footprint of the robot. In some examples, the pad holder assembly 190 is a solid rectangular plastic part that connects with all other parts within the robot body 110.

A vibration motor 196 is disposed on the top portion 194*a* of the pad holder body 194 (e.g., mounted vertically with respect to the floor surface 10). The vibration motor 196 vibrates the pad holder body 194, which in turn vibrates the cleaning pad 400 and provides a scrubbing action when the robot 100 is traversing the floor surface 10 for cleaning. In some examples, the vibration motor 196 is an orbital oscillator having less than 1 cm of orbital range, and having less than ½ cm of orbital range during at least part of the cleaning run, for example during parts of the run when the robot 100 is moving the cleaning pad 400 in a scrubbing motion. The combination of the back and forth movement of the robot 100 (previously discussed) and the vibration movement improves the scrubbing action of the robot 100, which removes resistant stains 22 including dried stains, like mud and coffee, and sticky stains, like jelly and honey. In some examples, a cylindrical tube 197 protrudes away from the top portion 194*a* of the pad holder body 194, and may be located in the center of the holder body 194. The cylindrical tube 197 houses the vibration motor 196 and any oscillating components or counter weights 198 allowing them to slide in place. In some examples, counter weights 198 are disposed on the top portion of the pad holder body 194 attached to the motor's rotational shaft. The counter weights 198 provide an off-centered weight and cause the motor to wobble. This in turn causes the vibrating and oscillating motion of the pad holder assembly 190. The weight of the robot 100 may be distributed between the drive wheels 124*a*, 124*b* and the pad holder assembly 190 at a ratio of 3 to 1, where the heaviest portion of the robot body 110 is either above the drive wheels 124*a*, 124*b* or above the pad holder assembly 190. In some examples, the center of gravity CGr of the robot 100 is positioned forward the drive wheels 124*a*, 124*b*, therefore causing a majority of an overall weight of the robot 100 to be positioned over the pad holder body 194. The overall weight of the robot 100 may be between about 2 lbs. to about 5 lbs. Positioning the majority of the overall weight of the robot 100 over the pad holder body 194 has the advantage of concentrating the application downward force at the cleaning pad 400 of this lightweight robot 100 and keeping the cleaning pad 400 in contact with the floor surface 10.

Figure 4:
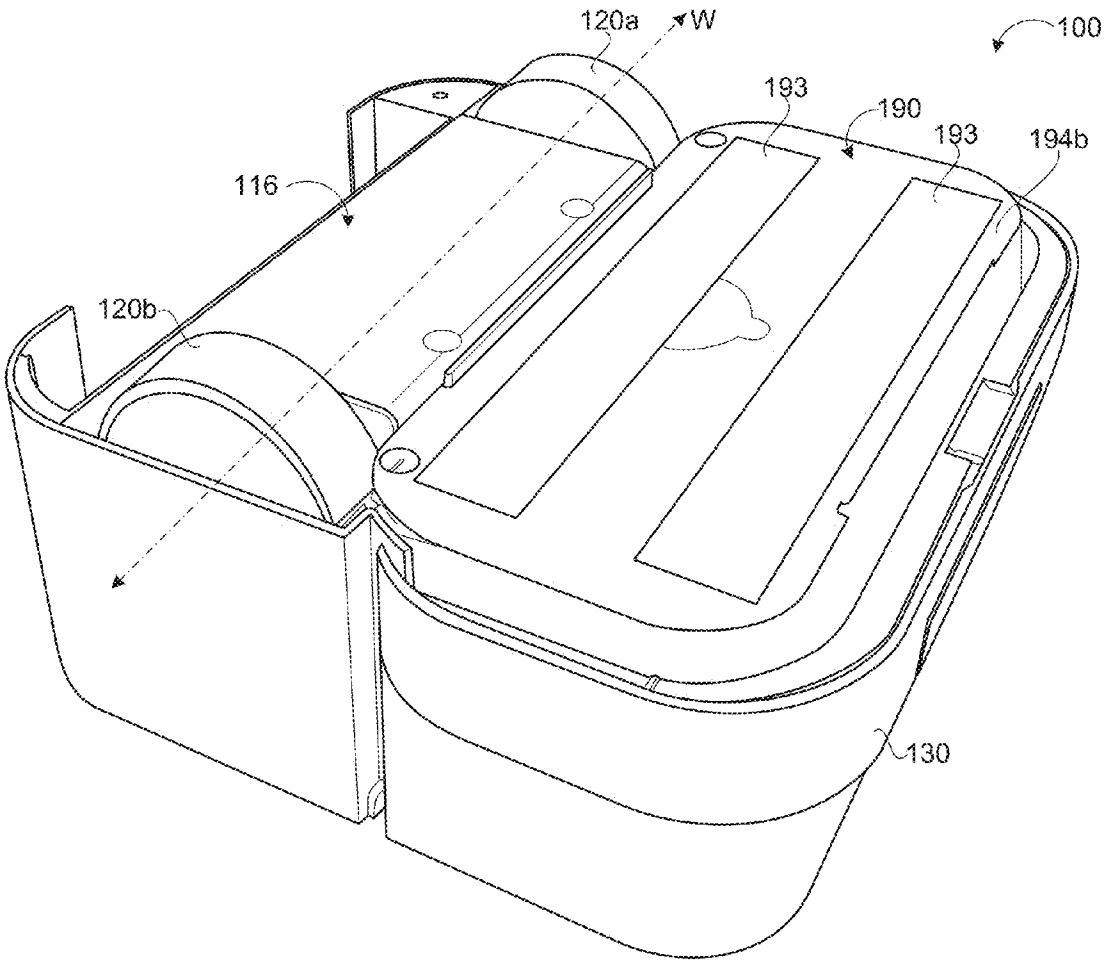
FIG. 4 is a bottom view of the exemplary autonomous mobile robot of FIG. 1.
Figure 10:
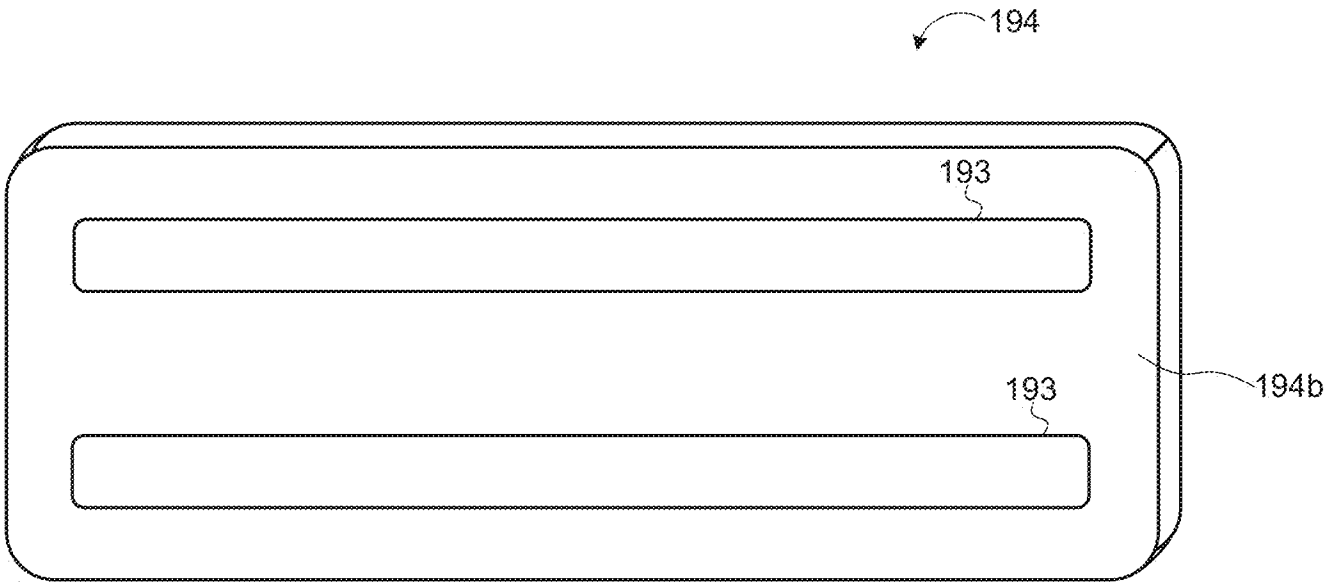
FIG. 10 is a front view of the pad holder body of the exemplary autonomous mobile robot of FIG. 1.

Referring to FIGS. 4 and 10, a retainer 193 is disposed on the bottom portion 194*b* of the pad holder body 194 for retaining the cleaning pad 400. The retainer 193 may include hook-and-loop fasteners. Other types of retainers may be used to connect the cleaning pad 400 to the pad holder body 194, such as brackets, which, as previously discussed, may be configured to allow the release of the cleaning pad 400 upon activation of a pad release mechanism located on the top portion 118 of the robot body 110.

In some examples, the pad holder assembly 190 includes at least one post 192 disposed on the top portion 194*a* of the pad holder body 194. The post 192 may have a cross sectional diameter varying in size along its length and is sized to fit in an aperture 113 defined by the robot body 110. As shown, the pad holder assembly 190 includes four posts 192. The robot body 110 includes four apertures 113 for receiving the four posts 192, attaching the pad holder assembly 190 to the robot body 110. Once assembled, the four posts 192 are inserted into the four apertures 113 of the robot body 110, interlocking the robot body 110 and the pad holder assembly 190. In some examples, the posts 192 are of a vibration dampening material to allow the pad holder assembly 190 to oscillate in the horizontal plane under the power of the motor 196 and allows for scrubbing. In addition, the posts 192 control the vibration in the vertical direction thereby controlling the spacing between the pad holder assembly 190 and the robot body 110.

The cleaning pad 400 is configured to absorb the fluid 172 that the sprayer 162 sprays on the floor surface 10 and any smears (e.g., dirt, oil, food, sauces, coffee, coffee grounds) that are being absorbed. Some of the smears may have viscoelastic properties, which exhibit both viscous and elastic characteristic (e.g., honey). The cleaning pad 400 is absorbent and has an outer surface that is abrasive. As the robot 100 moves about the floor surface 10, the cleaning pad 400 wipes the floor surface 10 with the abrasive side (i.e., the abrasion layer) and absorbs cleaning solution sprayed onto the floor surface 10 with only a light amount of force.

The cleaning pad 400 is designed, therefore, to wipe and absorb solution sprayed onto the floor surface 10 with very little application of downward force. The cleaning pad 400 may include an abrasive outer layer (not shown) and an absorbent inner layer for absorbing and retaining the fluid 172 that the robot 100 sprays on the floor surface 10. The abrasive outer layer is in contact with the floor surface 10, while the absorbent inner layer is attached to the bottom portion 194*b* of the holder pad 194. The abrasion layer helps scrub the surface floor 10 and remove stubborn stains 22 while the absorbent layer absorbs the fluid 172 and the dirt and debris. The cleaning pad 400 may leave a thin sheen on the floor surface 10 that will air dry and not leave marks. If the cleaning pad 400 absorbs too much fluid 172, the cleaning pad 400 may be suctioned to the floor due to the friction between the cleaning pad 400 and the floor surface 10. The abrasive outer liner is an absorbent material that picks up dirt and debris and leaves a thin sheen on the surface that will air dry and not leave marks.

The cleaning pad 400 is designed to be strong enough to withstand the vibration of the pad holder body 194, which causes the cleaning pad 400 to move back and forth and/or oscillate, thereby scrubbing as the robot 100 traverses the floor surface 10. The cleaning pad 400 has a top surface 400*a* attached to the bottom surface 194*b* of the pad holder 194. The top surface 400*b* of the pad 400 is substantially immobile relative to the oscillating pad holder 194 and more than 80 percent of the orbital range of the orbital oscillator is transmitted from the top surface 400*a* of the held cleaning pad 400 to the bottom surface 400*b* of the held cleaning pad 400 in contact with the floor surface 10. Moreover, the back and forth movement of the robot 100 alone, and/or in combination with oscillation of the pad, breaks down stains 22 on the surface floor 10, which the cleaning pad 400 absorbs.

In some implementations, as the cleaning pad 400 is cleaning a floor surface 10, it absorbs the cleaning fluid 172 applied to the floor surface 10. The cleaning pad 400 may absorb enough fluid 172 without changing its shape. The cleaning pad 400 has substantially similar dimensions before cleaning the floor surface 10 and after cleaning the floor surface. This characteristic of the cleaning pad 400 prevents the robot 100 from tilting backwards or pitching up if the cleaning pad 400 expands. In some examples, the cleaning pad 400 absorbs up to 180 ml or 90% of the total fluid 172 contained in the robot tank 170. The cleaning pad 400 is sufficiently rigid to support the front of the robot.

Figure 14:
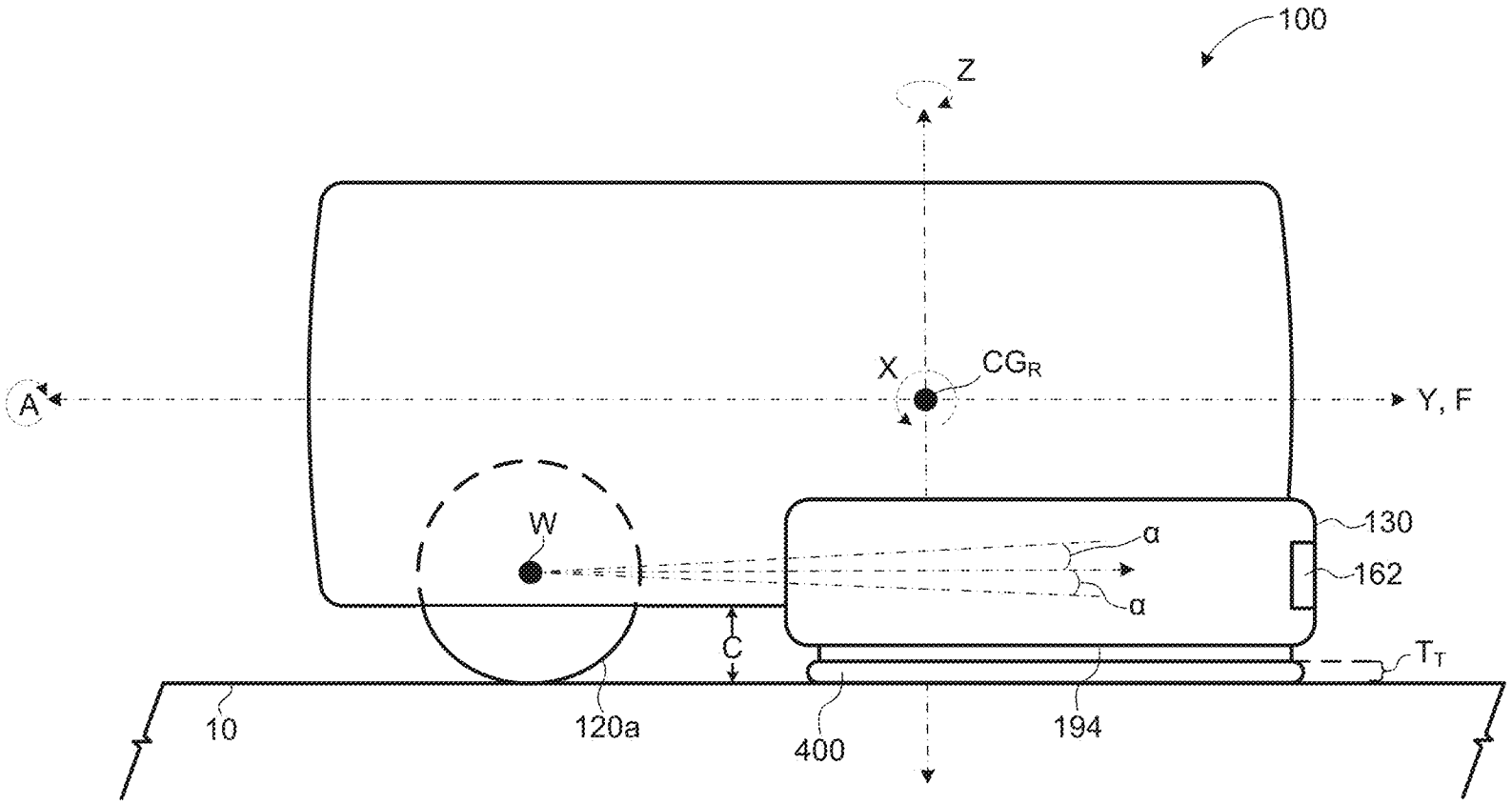
FIG. 14 is a side view of an exemplary autonomous mobile robot.

Referring to FIG. 14, the robot 100 has a clearance distance C from the floor surface 10 to the bottom surface 116 of the robot 100. Therefore, the cleaning pad 400 may have a minimal expansion rate to prevent the robot 100 from tilting. In some examples, the robot 100 may tilt about the wheel axis W due to the minimal increase in total pad thickness $T_T$. The robot 100 may have a threshold tilt angle $\alpha$ about the wheel axis W where the robot 100 may tilt without interference in its normal cleaning behavior.

Figure 15:
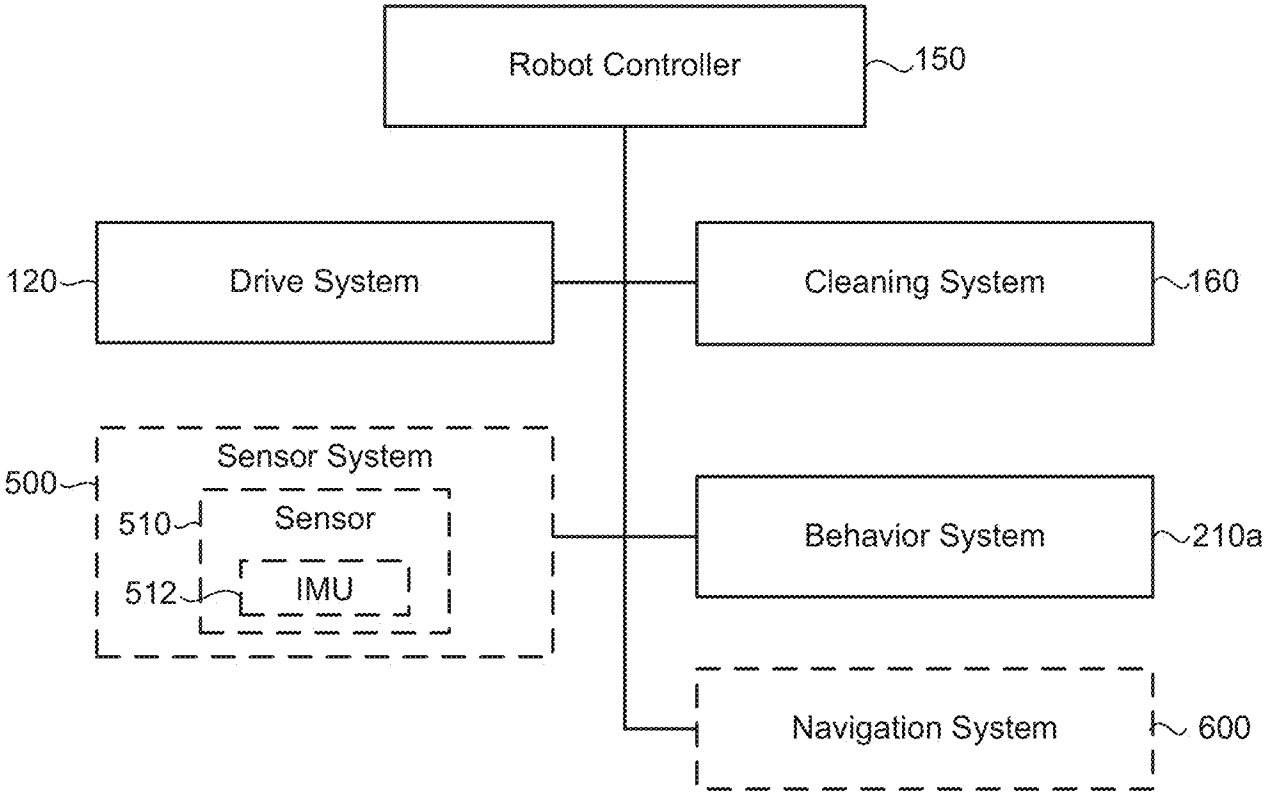
FIG. 15 is a schematic view of the robot controller of the exemplary autonomous mobile robot of FIG. 1.
Figure 16:
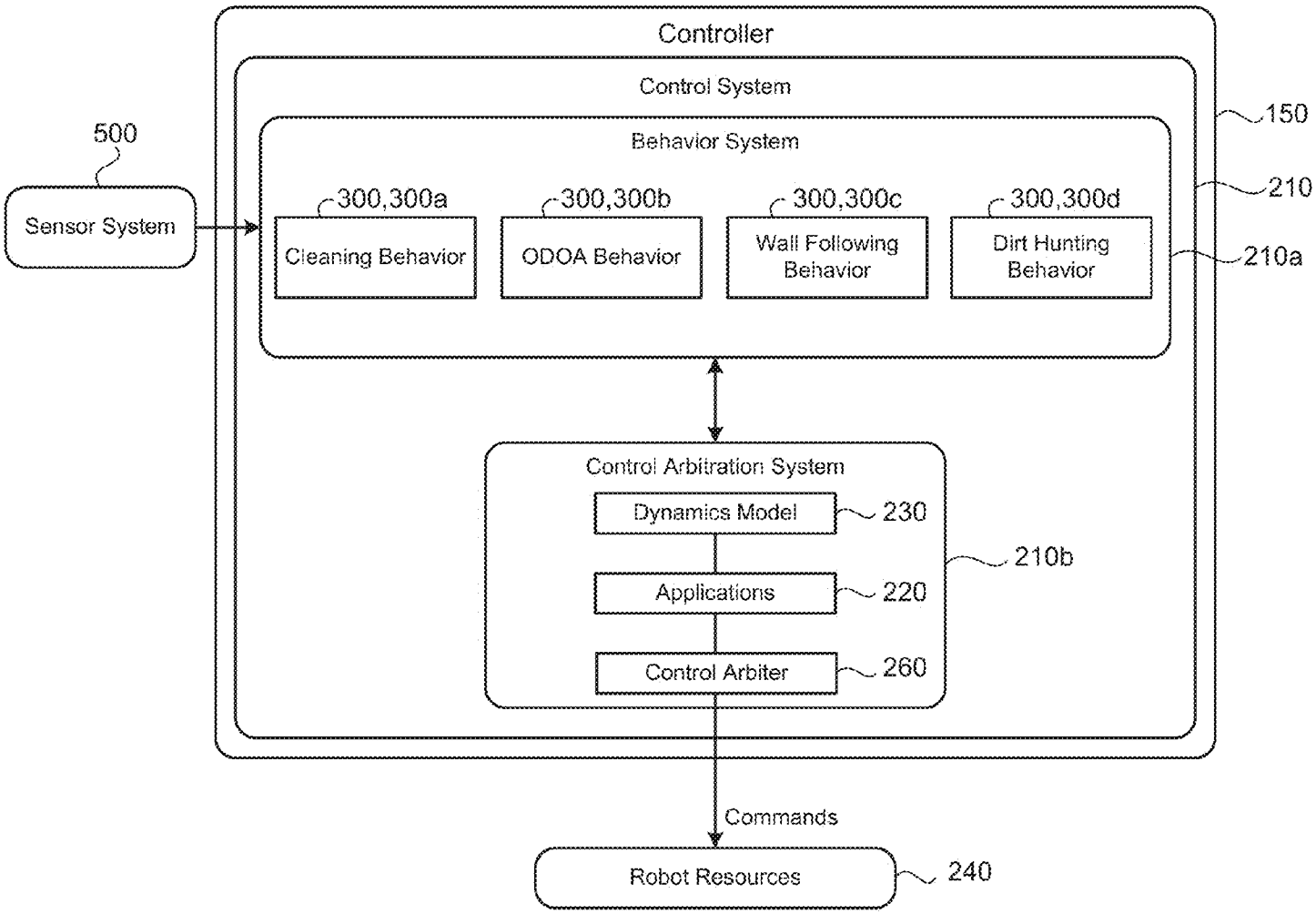
FIG. 16 is a perspective view of an exemplary autonomous mobile robot for cleaning.

Referring to FIGS. 15 and 16, to achieve reliable and robust autonomous movement, the robot 100 may include a sensor system 500 having several different types of sensors 510, which can be used in conjunction with one another to create a perception of the robot's 100 environment sufficient to allow the robot 100 to make intelligent decisions about actions to take in that environment. The sensor system 500 may include one or more types of sensors 510 supported by the robot body 110, which may include obstacle detection/obstacle avoidance (ODOA) sensors, communication sensors, navigation sensors, etc. For example, the sensor system 500 may include, but not limited to, proximity sensors (e.g. infrared sensors), contact sensors (e.g., bump switches), imaging sensors (e.g., volumetric point cloud imaging, three-dimensional (3D) imaging or depth map sensors, visible light camera and/or infrared camera), ranging sensors (e.g., sonar, radar, LIDAR (Light Detection and Ranging, which can entail optical remote sensing that measures properties of scattered light to find range and/or other information of a distant target), LADAR (Laser Detection and Ranging)), etc.

In some examples, the sensor system 500 includes an inertial measurement unit (IMU) 512 in communication with the controller 150 to measure and monitor a moment of inertia of the robot 100 with respect to the overall center of gravity $CG_R$ of the robot 100. The controller 150 may monitor any deviation in feedback from the IMU 512 from a threshold signal corresponding to normal unencumbered operation. For example, if the robot 100 begins to pitch away from an upright position, it may be impeded, or someone may have suddenly added a heavy payload. In these instances, it may be necessary to take urgent action (including, but not limited to, evasive maneuvers, recalibration, and/or issuing an audio/visual warning) in order to assure proper continued operation of the robot 100.

When accelerating from a stop, the controller 150 may take into account a moment of inertia of the robot 100 from its overall center of gravity $CG_R$ to prevent the robot 100 from tipping. The controller 150 may use a model of its pose, including its current moment of inertia. When payloads are supported, the controller 150 may measure a load impact on the overall center of gravity $CG_R$ and monitor movement of the robot 100 moment of inertia. If this is not possible, the controller 150 may apply a test torque command to the drive system 120 and measure actual linear and angular acceleration of the robot using the IMU 512, in order to experimentally determine operating limits.

The IMU 512 may measure and monitor a moment of inertia of the robot 100 based on relative values. In some implementations, and over a period of time, constant movement may cause the IMU 512 to drift. The controller 150 executes a resetting command to recalibrate the IMU 512 and reset it to zero. Before resetting the IMU 512, the controller 150 determines if the robot 100 is tilted, and issues the resetting command only if the robot 100 is on a flat surface.

In some implementations, the robot 100 includes a navigation system 600 configured to allow the robot 100 to navigate the floor surface 10 without colliding into obstacles 20 or falling down stairs, and to intelligently recognize relatively dirty floor areas for cleaning. Moreover, the navigation system 600 can maneuver the robot 100 in deterministic and pseudo-random patterns across the floor surface 10. The navigation system 600 may be a behavior based system stored and/or executed on the robot controller 150. The navigation system 600 may communicate with the sensor system 500 to determine and issue drive commands to the drive system 120. The navigation system 600 influences and configures the robot behaviors 300, thus allowing the robot 100 to behave in a systematic preplanned movement. In some examples, the navigation system 600 receives data from the sensor system 500 and plans a desired path for the robot 100 to traverse. In some examples, the navigation system 600 includes a map stored on the non-transitory-memory 154 of the robot 100 or on an external storage medium accessible by the robot 100 through wired or wireless means during a cleaning run. The robot 100 sensors 510 (FIG. 15) may include a camera and/or one or more ranging lasers for building a map of a space. In some examples, the robot controller 150 uses the map of walls, furniture, flooring changes and other obstacles to position and pose the robot 100 at locations far enough away from obstacles and/or flooring changes prior to the application of cleaning fluid 172. This has the advantage of applying fluid 172 to areas of floor surface 10 having no known obstacles thereon.

In some implementations, the controller 150 (e.g., a device having one or more computing processors 152 in communication with non-transitory memory 154 capable of storing instructions executable on the computing processor(s) 152) executes a control system 210, which includes a behavior system **210*a* and a control arbitration system 210*b* in communication with each other. The control arbitration system 210*b* allows robot applications 220 to be dynamically added and removed from the control system 210, and facilitates allowing applications 220 to each control the robot 100 without needing to know about any other applications 220. In other words, the control arbitration system 210*b* provides a simple prioritized control mechanism between applications 220 and resources 240 of the robot 100**.

In the example shown, the behavior system **210*a* includes an obstacle detection/obstacle avoidance (ODOA) behavior 300*b* for determining responsive robot actions based on obstacles 20 perceived by the sensor (e.g., turn away; turn around; stop before the obstacle, etc.). Another behavior 300 may include a wall following behavior 300*c* for driving adjacent a detected wall (e.g., in a wiggle pattern of driving toward and away from the wall). The behavior system 210*a* may include a dirt hunting behavior 300*d* (where the sensor(s) detect a dirty spot on the floor surface 10 and the robot 100 veers towards the spot for cleaning). Other behaviors 300 may include a spot cleaning behavior (e.g., the robot 100 follows a cornrow pattern to clean a specific spot), and a cliff behavior (e.g., the robot 100** detects stairs and avoids falling from the stairs).

Figure 17:
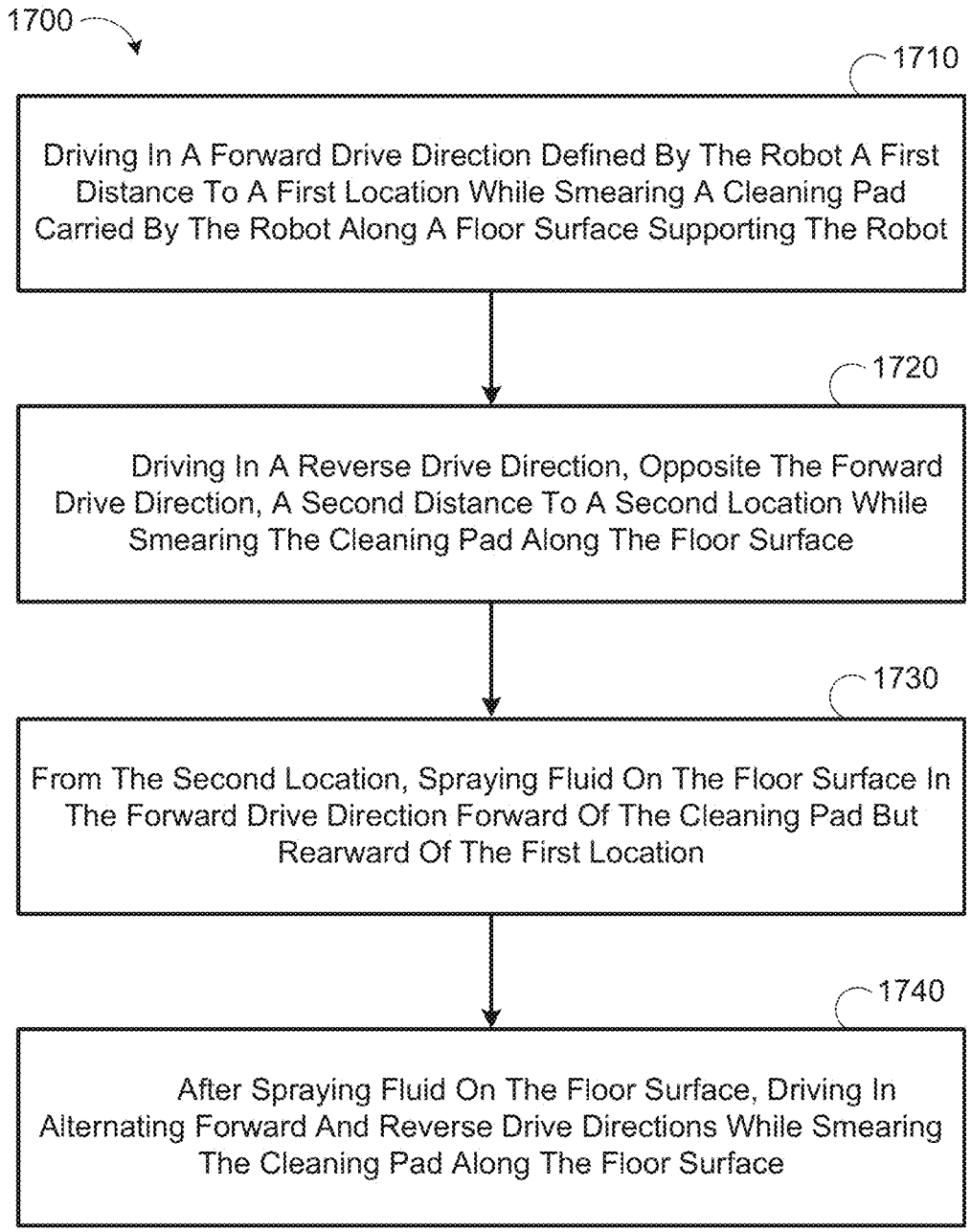
FIG. 17 is a schematic view of an exemplary arrangement of operations for operating the exemplary autonomous robot.

FIG. 17 provides an exemplary arrangement of operations for a method 1700 of operating an autonomous mobile robot 100. Referring also to FIGS. 13A-13E, the method 1700 includes driving 1710 a first distance $F_d$ in a forward drive direction F defined by the robot 100 to a first location $L_1$, while smearing applied fluid 172 with a cleaning pad 400 carried by the robot 100 along a floor surface 10 supporting the robot 100. The method 1700 further includes driving 1720 in a reverse drive direction A, opposite the forward drive direction F, a second distance $A_d$ to a second location $L_2$ while smearing applied fluid 172 with the cleaning pad 400 along the floor surface 10. The method 1700 also includes spraying 1730 fluid 172 on the floor surface 10 in the forward drive direction F forward of the cleaning pad 400 but rearward of the first location $L_1$, and driving 1740 in alternating forward and reverse drive directions F, A, while smearing the cleaning pad 400 along the floor surface 10 after spraying 1730 fluid 172 on the floor surface 10 (see FIGS. 13A-13E).

In some examples, the method 1700 includes driving a first distance $F_d$ in a forward drive direction F defined by the robot 100 to a first location $L_1$, while moving a cleaning pad 400 carried by the robot 100 along a floor surface 10 supporting the robot 100. The method 1700 further includes driving in a reverse drive direction A, opposite the forward drive direction F, a second distance $A_d$ to a second location $L_2$ while moving the cleaning pad 400 along the floor surface 10. The method 1700 also includes applying fluid 172 on the floor surface 10 in an area substantially equal to a footprint area AF of the robot in the forward drive direction F forward of the cleaning pad 400 but rearward of the first location $L_1$. The method 1700 further includes returning the robot 100 to the area of applied fluid in a movement pattern that moves the center area $P_C$ and left and right lateral edge areas $P_R$ and $P_L$ of the cleaning pad 400 separately through the area to moisten the cleaning pad 400 with the applied fluid 172. In some examples, the method 1700 includes applying fluid 172 on the floor surface 10 while driving in the reverse direction or after having driven in the reverse drive direction the second distance which is at least equal to the length of one footprint area AF of the robot 100. In some examples, the fluid applicator 162 applies fluid 172 to an area in front of the cleaning pad 400 and in the direction of travel of the mobile robot 100. In some examples, the fluid applicator 162 applies fluid 172 to an area that the cleaning pad 400 has occupied previously. In some examples, the area that the cleaning pad 400 has occupied is recorded on a stored map that is accessible to the controller 150.

The method 1700 may include driving in a left drive direction or a right drive direction while driving in the alternating forward and reverse directions after applying fluid 172 on the floor surface 10. Applying fluid 172 on the floor surface 10 may include spraying fluid 172 in multiple directions with respect to the forward drive direction F. In some examples, the second distance is greater than or equal to the first distance.

The mobile floor cleaning robot 10 may include a robot body 110, a drive system 120, a pad holder assembly 190, a reservoir 170, and a fluid applicator 162, such as for example a microfiber cloth or strip, a fluid dispersion brush, or a sprayer. The robot body 110 defines the forward drive direction and has a bottom portion 116. The drive system 120 supports the robot body 110 and maneuvers the robot 100 over the floor surface 10. The pad holder assembly 190 is disposed on the bottom portion 116 of the robot body 110 and holds the cleaning pad 400. The reservoir 170 is housed by the robot body 110 and holds a fluid 172 (e.g., 200 ml). The applicator 162, here a sprayer, which is also housed by the robot body 110, is in fluid communication with the reservoir 170 and sprays the fluid 172 in the forward drive direction forward of the cleaning pad 400. The cleaning pad 400 disposed on the bottom portion 116 of the pad holder assembly 190 may absorb about 90% of the fluid 172 contained in the reservoir 170. In some examples, the cleaning pad 400 has a width of between about 80 millimeters and about 68 millimeters and a length of between about 200 millimeters and about 212 millimeters. The cleaning pad 400 may have a thickness of between about 6.5 millimeters and about 8.5 millimeters.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A mobile robot comprising:

a robot body defining a forward drive direction;

a drive system supporting the robot body to maneuver the mobile robot across a floor surface;

a cleaning assembly disposed on the robot body, the cleaning assembly comprising:

a pad holder configured to receive a cleaning pad having a center and lateral edges; and a fluid applicator configured to apply fluid to the floor surface; and a controller in communication with the drive system and the cleaning assembly, the controller configured to control the drive system and fluid applicator while executing a cleaning routine comprising:

applying fluid to a floor surface area at an initial volumetric flow rate, the floor surface area being in front of the cleaning pad and in the forward drive direction of the mobile robot;

moving the mobile robot to the floor surface area in a movement pattern that moves the center and lateral edges of the cleaning pad separately through the floor surface area to moisten an exterior surface of the cleaning pad with the fluid applied to the floor surface area at the initial volumetric flow rate; and applying the fluid to the floor surface area at a subsequent volumetric flow rate when the exterior surface of the cleaning pad is moistened, the subsequent volumetric flow rate lower than the initial volumetric flow rate.

2. The robot of claim 1, wherein the fluid is applied to a floor surface area previously occupied by the cleaning pad.

3. The robot of claim 2, wherein the previously occupied floor surface area is stored on a map accessible to the controller.

4. The robot of claim 2, wherein fluid is applied to a floor surface area the robot has backed away from by a distance of at least one robot footprint length immediately prior to applying fluid.

5. The robot of claim 1, wherein executing the cleaning routine further comprises moving the cleaning pad in a birdsfoot motion forward and backward along a center trajectory, forward and backward along a trajectory to a left side of and heading away from a starting point along the center trajectory, and forward and backward along a trajectory to a right side of and heading away from a starting point along the center trajectory.

6. The robot of claim 1, wherein the drive system comprises right and left drive wheels disposed on corresponding right and left portions of the robot body, a center of gravity of the robot is positioned forward of the drive wheels, causing a majority of an overall weight of the robot to be positioned over the pad holder.

7. The robot of claim 6, wherein the overall weight of the robot is distributed between the pad holder and the drive wheels at a ratio of 3 to 1.

8. The robot of claim 6, wherein the overall weight of the robot is between about 2 lbs. and about 3 lbs.

9. The robot of claim 1, wherein the robot body and the pad holder both define substantially rectangular foot prints.

10. The robot of claim 1, further comprising a vibration motor disposed on a top portion of the pad holder.

* * * * *